US008299728B2

(12) United States Patent
Nakao

(10) Patent No.: US 8,299,728 B2
(45) Date of Patent: Oct. 30, 2012

(54) PRECHARGE CONTROLLING METHOD AND DISPLAY DEVICE USING THE SAME

(75) Inventor: Hiroshi Nakao, Kanagawa (JP)

(73) Assignee: Sony Corporation, Tokyo (JP)

( * ) Notice: Subject to any disclaimer, the term of this patent is extended or adjusted under 35 U.S.C. 154(b) by 660 days.

(21) Appl. No.: 12/197,385

(22) Filed: Aug. 25, 2008

(65) Prior Publication Data

US 2009/0058324 A1 Mar. 5, 2009

(30) Foreign Application Priority Data

Aug. 31, 2007 (JP) ..... 2007-227169

(51) Int. Cl.
*H05B 37/02* (2006.01)

(52) U.S. Cl. ..... 315/307; 327/148; 327/157

(58) Field of Classification Search ..... 315/307; 345/102; 327/148, 157, 16, 17; 323/234, 323/282

See application file for complete search history.

(56) References Cited

U.S. PATENT DOCUMENTS

| | | | | |
|---|---|---|---|---|
| 5,179,300 | A * | 1/1993 | Rolandi et al. | 326/83 |
| 6,157,178 | A | 12/2000 | Montanari | |
| 6,614,295 | B2 * | 9/2003 | Tsuchi | 327/563 |
| 7,135,921 | B2 * | 11/2006 | Tsuchi | 330/130 |
| 2004/0222954 | A1 * | 11/2004 | Lueder | 345/87 |
| 2004/0263436 | A1 | 12/2004 | Okuda | |
| 2005/0007325 | A1 * | 1/2005 | Kim et al. | 345/87 |
| 2006/0007205 | A1 * | 1/2006 | Reddy et al. | 345/204 |
| 2006/0022907 | A1 * | 2/2006 | Uchino et al. | 345/76 |
| 2006/0132240 | A1 | 6/2006 | Tu | |
| 2006/0139264 | A1 * | 6/2006 | Choi et al. | 345/76 |
| 2007/0057887 | A1 | 3/2007 | Itakura et al. | |

FOREIGN PATENT DOCUMENTS

| | | | |
|---|---|---|---|
| JP | 04-145490 | A | 5/1992 |
| JP | 2001-255851 | | 9/2001 |
| JP | 2001255851 | A * | 9/2001 |
| JP | 2004-354758 | A | 12/2004 |
| JP | 2005-099170 | | 4/2005 |
| JP | 2007-047221 | | 2/2007 |

OTHER PUBLICATIONS

EPO, European Search Report for European Application No. 09014533.7, mailed Feb. 19, 2010.

Japanese Patent Office, Office Action issued in Patent Application JP 2007-227169, on Sep. 8, 2009.

* cited by examiner

*Primary Examiner* — Douglas W Owens
*Assistant Examiner* — Amy Yang
(74) *Attorney, Agent, or Firm* — SNR Denton US LLP

(57) ABSTRACT

An embodiment of the invention provides a precharge controlling method, including the steps of: providing a voltage generating circuit with an output circuit for outputting a voltage having a necessary level, and a comparator; judging an output voltage from the output circuit in the comparator during a precharge time period, and feeding back an output signal from the comparator to the output circuit; and controlling a precharge voltage until the voltage having the necessary level outputted from the output circuit is reached.

10 Claims, 14 Drawing Sheets

PRECHARGE CONTROLLING METHOD AND DISPLAY DEVICE USING THE SAME

CROSS REFERENCES TO RELATED APPLICATIONS

The present invention contains subject matter related to Japanese Patent Application JP 2007-227169 filed in the Japan Patent Office on Aug. 31, 2007, the entire contents of which being incorporated herein by reference.

BACKGROUND OF THE INVENTION

1. Field of the Invention

The present invention relates to a precharge controlling method, and a display device using the same.

2. Description of Related Art

A capacitive coupling drive system is known as a system for driving a display device, for example, a liquid crystal display device. In the liquid crystal display device using the capacitive coupling drive system, pixel portions each of which is composed of a switching element, a liquid crystal pixel cell, and a coupling capacitor Cs are formed so as to correspond to intersection portions in which scanning lines and signal lines intersect with each other, respectively. In this case, an offset voltage is applied as a potential to the pixel cell by using the coupling capacitor Cs after a video signal Vsig is written to the pixel cell, thereby driving the pixel cell. This technique, for example, is described in Japanese Patent Laid-Open No. 2001-255851. That is to say, the coupling capacitor Cs is driven by using a necessary voltage (hereinafter referred to as "a coupling voltage") Vcs after the video signal Vsig is written to the pixel cell, and the pixel cell is driven by using a pixel potential obtained by adding the video signal Vsig and the coupling voltage Vcs to each other. According to the capacitive coupling drive system, the video signal Vsig can be written to the pixel cell at a high speed and the low power consumption can be realized because of a small amplitude of the video signal Vsig.

A pixel potential Vpix applied to the pixel cell when the capacitive coupling drive is carried out is expressed by Expression (1):

$$Vpix=Vsig+(Cs/(Cs+Clc))\times Vcs \quad (1)$$

where Vpix is the pixel potential, Vsig is the video signal (an amplitude of the video signal on the signal line), Cs is a coupling capacitance of the coupling capacitor, Clc is a capacitance of the liquid crystal cell with a counter electrode, and Vcs is the coupling voltage with which the coupling capacitor Cs is driven. Here, Expression (1) is described in Japanese Patent Laid-Open No. 2007-47221.

Heretofore, the coupling voltage with which the coupling capacitor Cs is driven is set at a certain fixed potential. However, as shown in Expression (1), the pixel potential Vpix depends on a capacitance ratio of the coupling capacitance Cs to a sum of the coupling capacitance Cs and the holding capacitance Clc of the pixel cell. As a result, the manufacture dispersion and the fluctuation of the relative permittivity due to the ambient temperature cause the reduction in yield, and the deterioration of the image quality. A method devised in order to cope with such a situation is described in Japanese Patent Laid-Open No. 2007-47221. According to this method, the coupling voltage Vcs is controlled, so that the coupling capacitance Cs is driven by using the optimal coupling voltage Vcs without depending on the manufacture dispersion and the ambient temperature (the so-called environmental temperature).

Also, Japanese Patent Laid-Open No. 2005-99170 discloses a precharge operation of a drive circuit which will be described later.

SUMMARY OF THE INVENTION

Now, in the technique described in Japanese Patent Laid-Open No. 2007-47221, the coupling voltage is controlled to obtain optimal one after the effective display for the pixel is started. As a result, in an initial stage of start of the effective display for the pixel, an error occurs between the optimal coupling voltage value and the coupling voltage value supplied to the display device. This error causes a problem that for example, in an initial stage of the activation, a contrast of the entire panel picture becomes high, and contrary, an image is darkly displayed in the entire panel surface. In addition, when a time required to output normally the coupling voltage Vcs as shown by an output waveform 102 in FIG. 16 which will be described later is long, this is felt in the form of blurring of the picture.

In order to cope with such a situation, it is desired that in the initial stage of the activation of the display device, the coupling voltage is automatically corrected to obtain optical one irrespective of the manufacture dispersion and the temperature change. That is to say, it is desired that the precharge error is reduced so as to become zero as expeditiously as practicable to shorten the precharge time period by properly controlling the precharge operation until the optimal coupling voltage is reached, thereby enhancing the image quality.

Now, let us consider an output circuit system, using a low-pass filter LPF, shown in FIG. 17. The output circuit system is configured such that an output voltage Vout from an output circuit 1 is inputted to a comparator 2 to be compared with a reference voltage Vref, thereby making a judgment about the comparison, and the judgment result is fed back to the output circuit 1 again through a charge pump 3 and a low-pass filter (LPF) 4. In such an output circuit system, a potential of a capacitor Cin of the low-pass filter 4 corresponding to an output load capacitor Cout and an input capacitor of the output circuit 1 need to be precharged at a certain value as the precharge operation. The precharge operation of the drive circuit is shown in Japanese Patent Laid-Open No. 2005-99170.

However, with the technique described in Japanese Patent Laid-Open No. 2005-99170, the precharge is performed for the output load capacitor. Thus, in the application of the output circuit system shown in FIG. 16, the potential of the capacitor Cin of the low-pass filter 4 must be precharged at an input voltage which is exclusively determined for the output voltage Vout from the output circuit 1. The reason for this is because when only one of the capacitor Cin on the input side or the output load capacitor Cout is precharged, an operating point after completion of the precharge control does not agree with that during the normal operation, so that an output error may occur. Therefore, the output load capacitor Cout and the load capacitor Cin on the input side must be simultaneously precharged.

FIG. 16 schematically shows output waveforms when the precharge error occurs before and after the precharge time period. In FIG. 16, an axis of ordinate represents the output voltage, and an axis of abscissa represents time. A time period ranging from the activation phase to a time point when the optimal output voltage Vcs is obtained is the precharge time period (corresponding to a blanking time period in a liquid crystal panel) A. Also, a time period in and after the optimal output voltage Vcs is obtained becomes a normal operating time period C. A curve 101 represents an output waveform when the precharge voltage is controlled, and a curve 102 represents an output waveform when no precharge voltage is controlled. A potential difference before and after completion of the precharge time period between the curves 101 and 102 is called a precharge error C.

When the precharge error C and a return time D shown in FIG. 16 falls within the range of the sensitivity of the eye of the human being, they are recognized as the blurring of the picture. For this reason, the quantitative estimation for the precharge voltage becomes necessary.

In addition, when a output circuit configured in the form of a source follower circuit is used, there is expected a method of applying suitable given voltages to the output load capacitor Cout and the input capacitor Cin, respectively. However, since (output voltage−input voltage)=Vgs≈Vth depends on the dispersion due to the manufacturing process, the precharge error D occurs even when the fixed potentials are uniformly applied thereto, respectively.

In order to cope with such a situation, it is necessary to provide a circuit for performing the control so as to obtain the optimal precharge voltage without depending on the power source voltage, the manufacture dispersion, the load current and the like.

On the other hand, it is desired to realize the reduction in power source voltage and the wide dynamic range of the output circuit including the precharge function as well. The reason for this is described as follows. The pixel potential Vpix when the capacitive coupling drive is carried out in the liquid crystal display device is expressed by Expression (1).

In recent years, the operation with the low power source voltage is desired for the purpose of attaining the reduction in power consumption of the liquid crystal display device. However, for example, about 4 V is required as the pixel potential for the white display in a VA liquid crystal. In addition, it is known that increasing the amplitude of the video signal Vsig is not a wise plan from a viewpoint of the power consumption. That is to say, according to Expression (1), the large coupling voltage Vcs is desired even for the reduction in power source voltage. Thus, these problems can be solved with the circuit configuration in which the dynamic ranges of the input voltage Vin and the output voltage Vout which can be controlled with the precharge are wide, and the output can be made close to the power source voltage.

The problems described above are caused not only in the liquid crystal display device, but also in an organic electroluminescent display device using the capacitive coupling drive system.

In the light of the foregoing, it is therefore desirable to provide a precharge controlling method which is capable of enhancing precision for a precharge operation until a proper voltage having a necessary level is reached in an activation phase, and realizing shortening of a precharge time period in a voltage generating circuit for outputting the proper voltage having the necessary level.

It is also desirable to provide a precharge controlling method which is capable of allowing a precharge operation having a wide dynamic range.

It is further desirable to provide a display device using the precharge controlling method.

In order to attain the desire described above, according to an embodiment of the present invention, there is provided a precharge controlling method, including the steps of:

providing a voltage generating circuit with an output circuit for outputting a voltage having a necessary level, and a comparator;

judging an output voltage from the output circuit in the comparator during a precharge time period, and feeding back an output signal from the comparator to the output circuit; and controlling a precharge voltage until the voltage having the necessary level outputted from the output circuit is reached.

With the precharge controlling method according to the embodiment of the present invention, the output voltage from the output circuit is fed back to the output circuit through the comparator, which results in that the output voltage from the output circuit is properly precharged, thereby making it possible to output the proper voltage having the necessary level right after start of a normal operation. That is to say, it is possible to reduce the precharge error.

According to another embodiment of the present invention, there is provided a display device, including:

pixel portions disposed so as to correspond to intersection portions in which scanning lines and signal lines intersect with each other, respectively, each of the pixel portions being composed of a switching element, a pixel cell and a coupling capacitor; and a voltage generating circuit for supplying a coupling voltage to each of the coupling capacitors;

in which the voltage generating circuit includes an output circuit for outputting the coupling voltage, and a comparator;

during a precharge time period, the comparator judges the output voltage from the output circuit, and an output signal from the comparator is fed back to the output circuit; and a precharge voltage until the coupling voltage outputted from the output circuit is reached is controlled.

With the display device according to the another embodiment of the present invention, the output voltage from the output circuit is fed back to the output circuit through the comparator, which results in that the output voltage from the output circuit is properly precharged, thereby making it possible to output the proper voltage having the necessary level right after start of a normal operation. That is to say, it is possible to reduce the precharge error during the precharge operation until the optimal coupling voltage is reached.

According to the precharge controlling method of the embodiment of the present invention, the precision for the precharge operation until the proper voltage having the necessary level is reached in the activation phase can be enhanced, thereby making it possible to shorten the precharge time period in the voltage generating circuit for outputting the proper voltage having the necessary level. As a result, it is possible to accelerate the start-up of the normal operation.

According to the precharge controlling method of the embodiment of the present invention, the bias current in the output circuit is controlled through the voltage-current feedback circuit, thereby making it possible to further widen the dynamic range of the output voltage in the output circuit.

According to the display device of the another embodiment of the present invention, in the voltage generating circuit for outputting the proper coupling voltage used to drive the coupling capacitor of the pixel portion, the precision for the precharge operation until the proper coupling voltage is reached in the activation phase can be enhanced, thereby making it possible to shorten the precharge feedback. As a result, it is possible to accelerate the start-up of the normal operation of the display device.

DETAILED DESCRIPTION OF THE PREFERRED EMBODIMENTS

Preferred embodiments of the present invention will be described in detail hereinafter with reference to the accompanying drawings.

Figure 1:
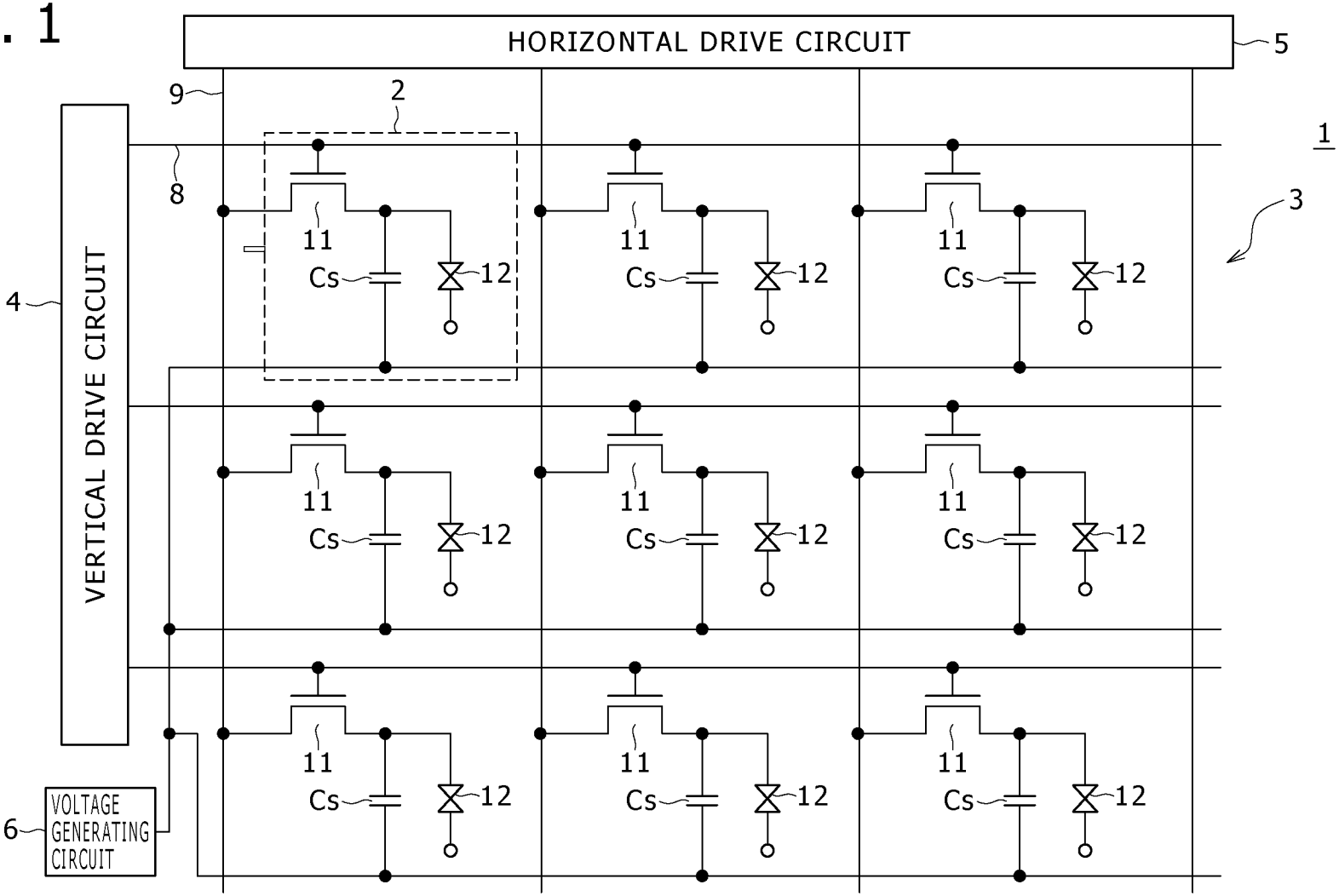
FIG. 1 is a schematic configuration diagram when a display device using a capacitive coupling device system according to the present invention is applied to a liquid crystal display device.

FIG. 1 shows a schematic configuration of a liquid crystal display device using a capacitive coupling drive system as a display device. A liquid crystal display device 1 according to an embodiment mode of the present invention includes a pixel array portion 3, a vertical drive circuit 4, a horizontal drive circuit 5, and a voltage generating circuit 6. In this case, the pixel array portion 3 has a plurality of pixel portions 2 which are two-dimensionally disposed. The vertical drive circuit 4 and the horizontal drive circuit 5 drive the pixel array portion 3. Also, the pixel portions 2 are disposed so as to correspond to intersection portions in which scanning lines 8 wired in rows, and signal lines 9 wired in columns intersect with each other, respectively. Each of the pixel portions 2 is composed of a thin film transistor 11 as a switching element, a pixel cell (that is, a liquid crystal cell) 12 connected to the thin film transistor 11, and a coupling capacitor Cs.

A gate of the thin film transistor 11 is connected to corresponding one of the scanning lines 8, a source thereof is connected to corresponding one of the signal lines 9, and a drain thereof is connected to corresponding one of pixel electrodes of the pixel cells 12. In addition, one terminal of the coupling capacitor Cs provided in each of the pixel portions 2 is connected to the drain of the corresponding one of the thin film transistors 11, and the other terminal thereof is connected to an output terminal of the voltage generating circuit 6.

The vertical drive circuit 4 successively scans the scanning lines 8 to select the pixel column for one row. The horizontal drive circuit 5 outputs a video signal Vsig through each of the signal lines 9. The video signal Vsig is then supplied to each of the pixel cells 12 for one row selected by the vertical drive circuit 4 within one horizontal time period through the corresponding one of the thin film transistors 11. On the other hand, a voltage having a necessary level, that is, a coupling voltage Vcs used to drive each of the coupling capacitors Cs is outputted from the voltage generating circuit 6. The coupling voltage Vcs is applied to each of the pixel electrodes of the pixel cells 12 through the corresponding one of the coupling capacitors Cs. That is to say, a pixel voltage obtained by adding the video signal Vsig and the coupling voltage Vcs to each other is applied to each of the pixel cells 12 for one row selected by the vertical drive circuit 4 within one horizontal time period through the corresponding one of the thin film transistors 11.

This embodiment mode of the present invention adopts such a configuration that the voltage generating circuit 6 can carried out a precharge operation with a less error in a phase of activation (for a blanking time period) while the coupling voltage Vcs is optimally controlled. The precharge operation means an operation for a time period for which a precharge voltage rises until the optimal coupling voltage Vcs is reached in the phase of the activation in the voltage generating circuit 6.

Figure 2:
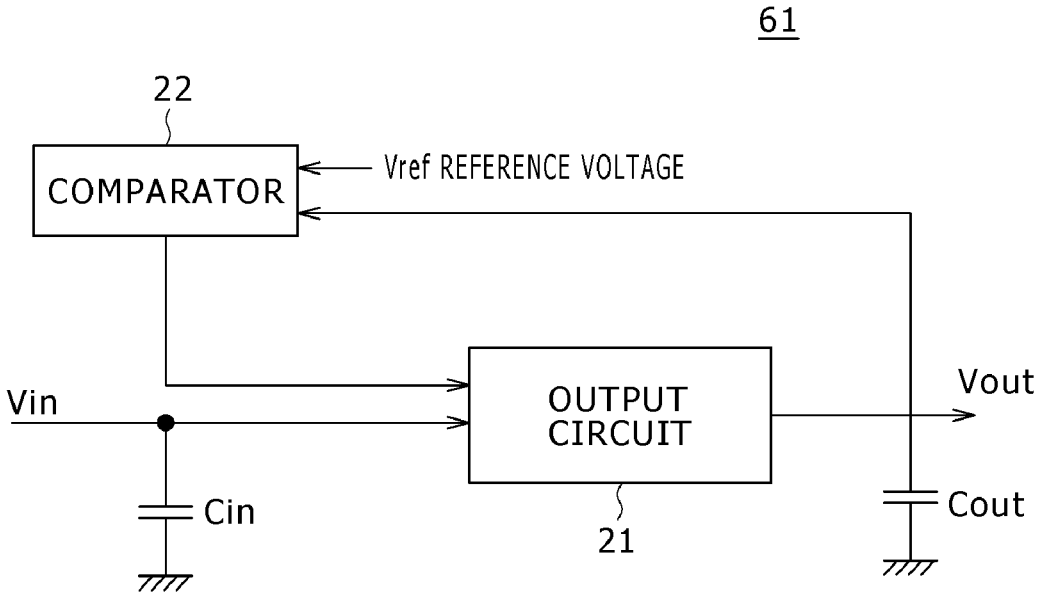
FIG. 2 is a block diagram, partly in circuit, showing a voltage generating circuit in a liquid crystal display device according to a first embodiment of the present invention.
Figure 17:
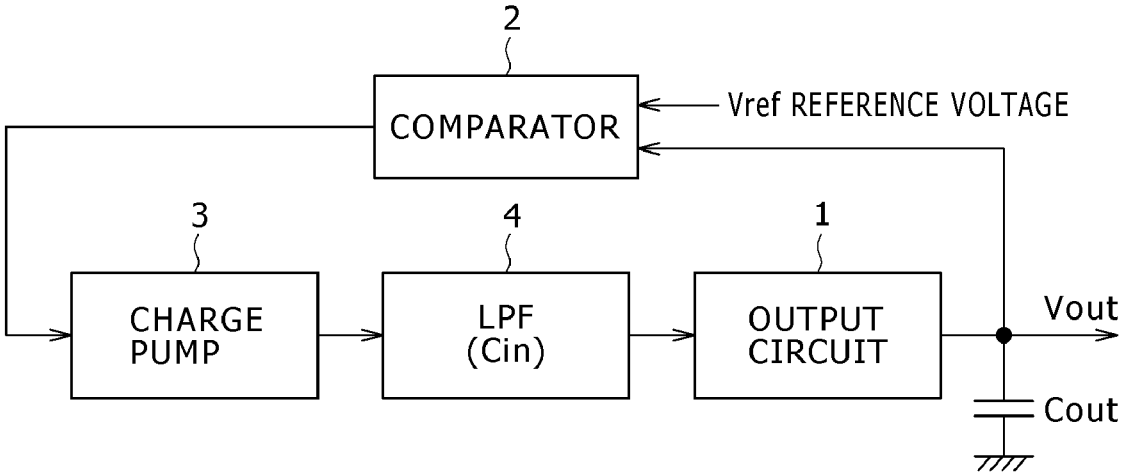
FIG. 17 is a block diagram, partly in circuit, showing an output circuit system according to a reference example in the related art.

FIG. 2 is a block diagram, partly in circuit, showing a configuration of a voltage generating circuit 61 in a liquid crystal display device according to a first embodiment of the present invention. The voltage generating circuit 61 in the liquid crystal display device according to this embodiment includes an output circuit 21 and a comparator 22. In this case, the comparator 22 compares an output voltage Vout from the output circuit 21 with a reference voltage Vref, and feeds an output voltage about a judgment result based on the comparison back to one input side of the output circuit 21. The low-pass filter 4 shown in FIG. 17 has the capacitor Cin. The capacitor Cin corresponds to an input capacitor Cin in the output circuit 21 shown in FIG. 2. An input voltage Vin is inputted to the other input terminal of the output circuit 21. Also, an output capacitor Cout is connected to an output side of the output circuit 21.

Figure 3:
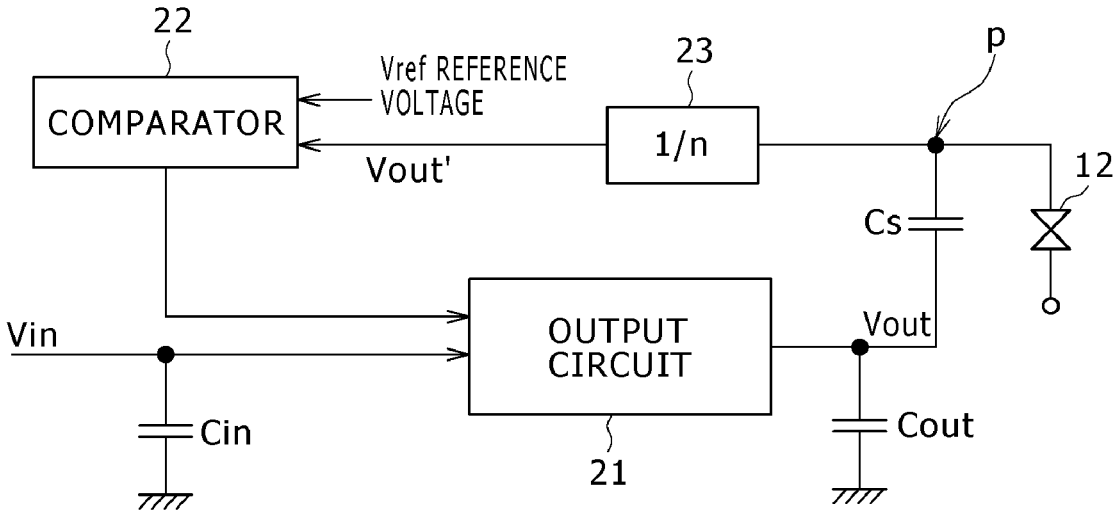
FIG. 3 is a block diagram, partly in circuit, showing a system for inputting a reference voltage and an output voltage from an output circuit to a comparator in the voltage generating circuit in the liquid crystal display device according to the first embodiment of the present invention.

Here, although the details of a system for determining the reference voltage Vref which is inputted to one input terminal of the comparator 22 is omitted here for the sake of simplicity, it is assumed as shown in FIG. 3 that the reference voltage Vref is a given voltage obtained by multiplying a desired optimal pixel potential Vpix by (1/n). Also, it is assumed that based on the reference voltage Vref, the output voltage which is inputted to the other input terminal of the comparator 22 is a voltage Vout' obtained by reducing the pixel potential Vpix obtained at a point P (pixel electrode) at which the video signal Vsig and the output voltage Vout are added to each other to Vpix×(1/n) through a voltage reducing circuit 23. This configuration also applies to embodiments which will be described later.

Figure 4:
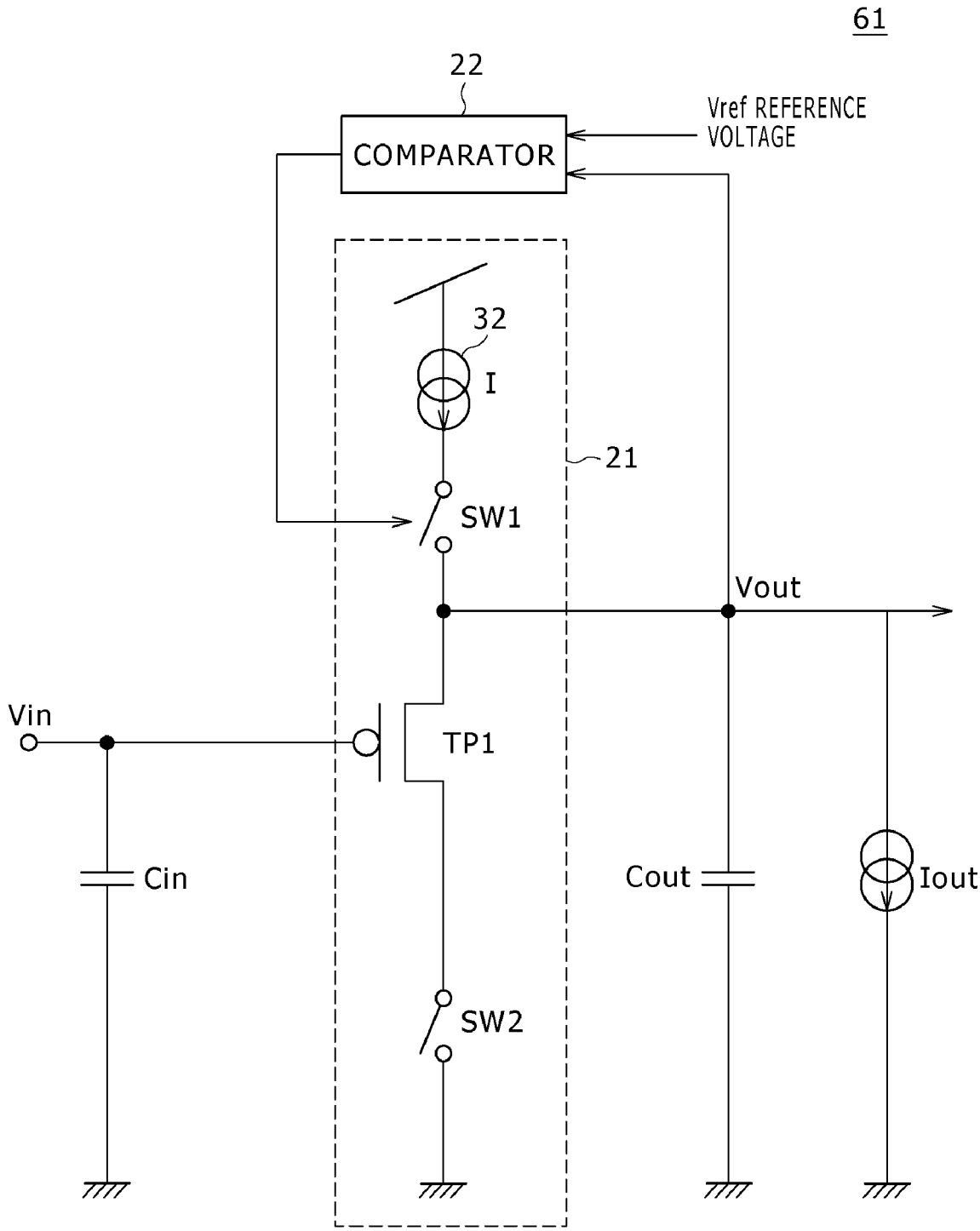
FIG. 4 is a circuit diagram showing a concrete precharge circuit of the voltage generating circuit in the display device according to the first embodiment of the present invention.

FIG. 4 shows an example of a configuration of the voltage generating circuit 61 in the liquid crystal display device 1 of the first embodiment, especially, a concrete precharge circuit thereof. In the circuit configuration in this embodiment, the output circuit 21 is configured in the form of a source follower circuit in which the output circuit 21 is composed of a drive transistor TP1 composed of, for example, a p-channel MOS transistor, and a constant current source 32. An output terminal is derived from a connection midpoint between a source of the drive transistor TP1 and the constant current source 32. A first switch SW1 is connected between the constant current source 32 and the connection midpoint, and a second switch SW2 is connected between a drain of the drive transistor TP1 and the ground (earth). The input capacitor Cin is connected to an input terminal of the source follower circuit, that is, a gate of the drive transistor TP1, and the output capacitor Cout is connected to an output terminal of the source follower circuit. An input voltage Vin is supplied to the input terminal of the source follower circuit. The first switch SW1 is controlled to be turned ON or OFF in accordance with the output voltage signal from the comparator 22. An output load current designated by reference symbol Iout is a current consumed on the pixel portion side.

Next, a description will be given with respect to an operation of the voltage generating circuit 61 having the precharge circuit configuration shown in FIG. 4. The second switch SW2 is normally in an OFF state for the precharge time period. For the precharge time period, the first switch SW1 is controlled to be turned ON or OFF in accordance with the output voltage signal from the comparator 22. That is to say, for the precharge time period, the first switch SW1 is turned ON or OFF in accordance with the result of comparison of the output voltage Vout from the output circuit 21 with the reference voltage Vref in the comparator 22.

That is to say, when Vout<Vref, the first switch SW1 is turned ON, and when Vout>Vref, the first switch SW1 is turned OFF.

It is assumed that the output voltage Vout is lower than the optimal precharge voltage (=Vcs) as an initial state. At this time, the first switch SW1 is turned ON concurrently with start of the precharge operation, a part of a bias current I caused to flow from the constant current source 32 is consumed in the form of an output load current Iout, and a remaining part thereof is caused to flow through the output capacitor Cout to charge the output capacitor Cout.

When the output capacitor Cout is charged with the electricity, so that the output voltage Vout becomes equal in level to the reference voltage Vref in the comparison made in the comparator 22, the first switch SW1 is turned OFF, and as a result, no bias current I is supplied from the constant current source 32.

When the output voltage Vout becomes higher than the optimal precharge voltage, the first switch SW1 is turned OFF. As a result, the supply of the bias current I to the first capacitor Cout is interrupted. When the output load current Iout≈0, the charges are discharged from the output capacitor Cout. Also, when the output voltage Vout<the reference voltage Vref is obtained, the first switch SW1 is turned ON again, thereby supplying the bias current I to the output capacitor Cout. This operation is repeatedly carried out, which results in that finally, the relationship of the output voltage Vout<the reference voltage Vref is obtained, and thus an equilibrium condition is obtained.

According to the first embodiment described above, in the voltage generating circuit 61, the output voltage Vout from the output circuit is fed back to the output circuit through the comparator 22. Specifically, the first switch SW1 is controlled to be turned ON or OFF in accordance with the judgment result in the comparator 22, thereby controlling the flow of the bias current I to the drive transistor TP1. Firstly, the proper precharge voltage, that is, the optimal coupling voltage Vcs is obtained from the output circuit 21. Therefore, the precharge error can be reduced and the precision for the precharge operation in the activation phase can be enhanced as compared with the case where the coupling voltage is used as the fixed voltage in the related art.

The precision for the precharge operation can be enhanced and the precharge time period, that is, the time period until completion of the activation can be shortened while the coupling voltage Vcs is optimally controlled. In the liquid crystal display device, the normal operation can be entered a little early and the deterioration of the image quality in the early phase of the display can be avoided.

Here, in this embodiment of the present invention, both the input capacitor Cin and the output capacitor Cout have the large capacitance values, respectively. The output capacitor Cout, for example, is used, as the application, as the drive power source for the coupling capacitor Cs of the pixel. Thus, the capacitance value of the output capacitor Cout needs to be much larger than a total value of the capacitance values of the coupling capacitors Cs (for one line of the pixels) which are driven at a time. If this necessity is not met, the output voltage Vout is reduced as soon as the charges are supplied to each of the coupling capacitors Cs (for one line of the pixels). Since the capacitance value of the destination of supply of the charges is on the order of pF to nF although depending on the object, the output capacitor Cout having the capacitance value approximately on the order of about μF ($10^{-6}$ F) is generally used. The output capacitor Cout having the large capacitance value is used as the application of, for example, the liquid crystal display device. Thus, in order to obtain the stable operation in terms of the control system, the input capacitor Cin also needs to have the large capacitance value approximately equal to that of the output capacitor Cout. For this reason, the capacitance value of the input capacitor Cin is also on the order of about μF. This configuration also applies to each of the following embodiments.

Figure 5:
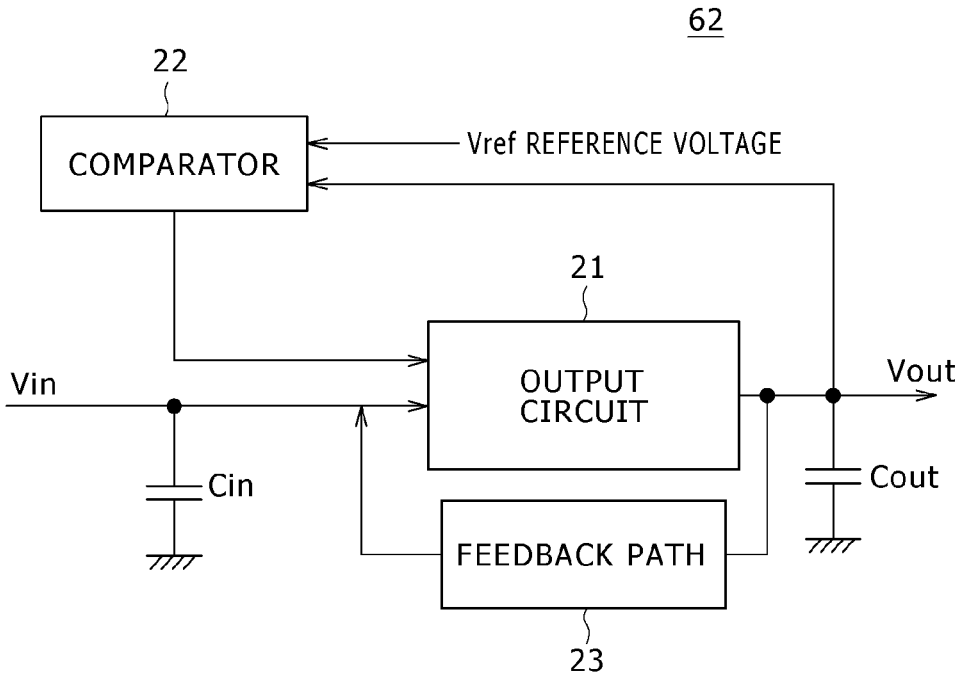
FIG. 5 is a block diagram, partly in circuit, showing a voltage generating circuit in a liquid crystal display device according to a second embodiment of the present invention.

FIG. 5 is a block diagram, partly in circuit, showing a configuration of a voltage generating circuit in a liquid crystal display device according to a second embodiment of the present invention.

When in the block configuration shown in FIG. 2, the output circuit 21 is configured in the form of the general source follower circuit, a relationship of Expression (2) is established:

$$Vout = Vin + |Vgs(ID)| \quad (2)$$

Where Vgs (ID) is a gate to source voltage of the drive transistor TP1, and differs depending on the conditions such as the bias current ID caused to flow through the drive transistor TP1, the manufacture dispersion and the temperature. Therefore, when the constant voltage which is uniform with respect to the output voltage Vout is applied as the input voltage Vin, the precharge error becomes easy to occur. In other words, even when only the output side of the output circuit 21 is charged to have the necessary voltage, the output voltage generates the precharge error so as to follow the input voltage as long as the constant voltage which is not controlled is applied to the input side of the output circuit 21.

The second embodiment shown in FIG. 5 provides one method of improving the problem described above. A voltage generating circuit 62 in a liquid crystal display device of this embodiment includes an output circuit 21 and a comparator 22, and also includes a feedback path 23. In this case, the feedback path 23 is provided between an input terminal and an output terminal of the output circuit 21, and serves to directly feed the output voltage Vout back to the input side of the output circuit 21. Since other configurations and connection relationships are the same as those in the first embodiment shown in FIG. 2, a detailed description thereof is omitted here for the sake of simplicity. In this embodiment, it is possible to perform the control for determining the optimal input voltage Vin from the output voltage Vout from the output circuit 21 depending on the manufacturing process conditions and the load conditions.

Figure 6:
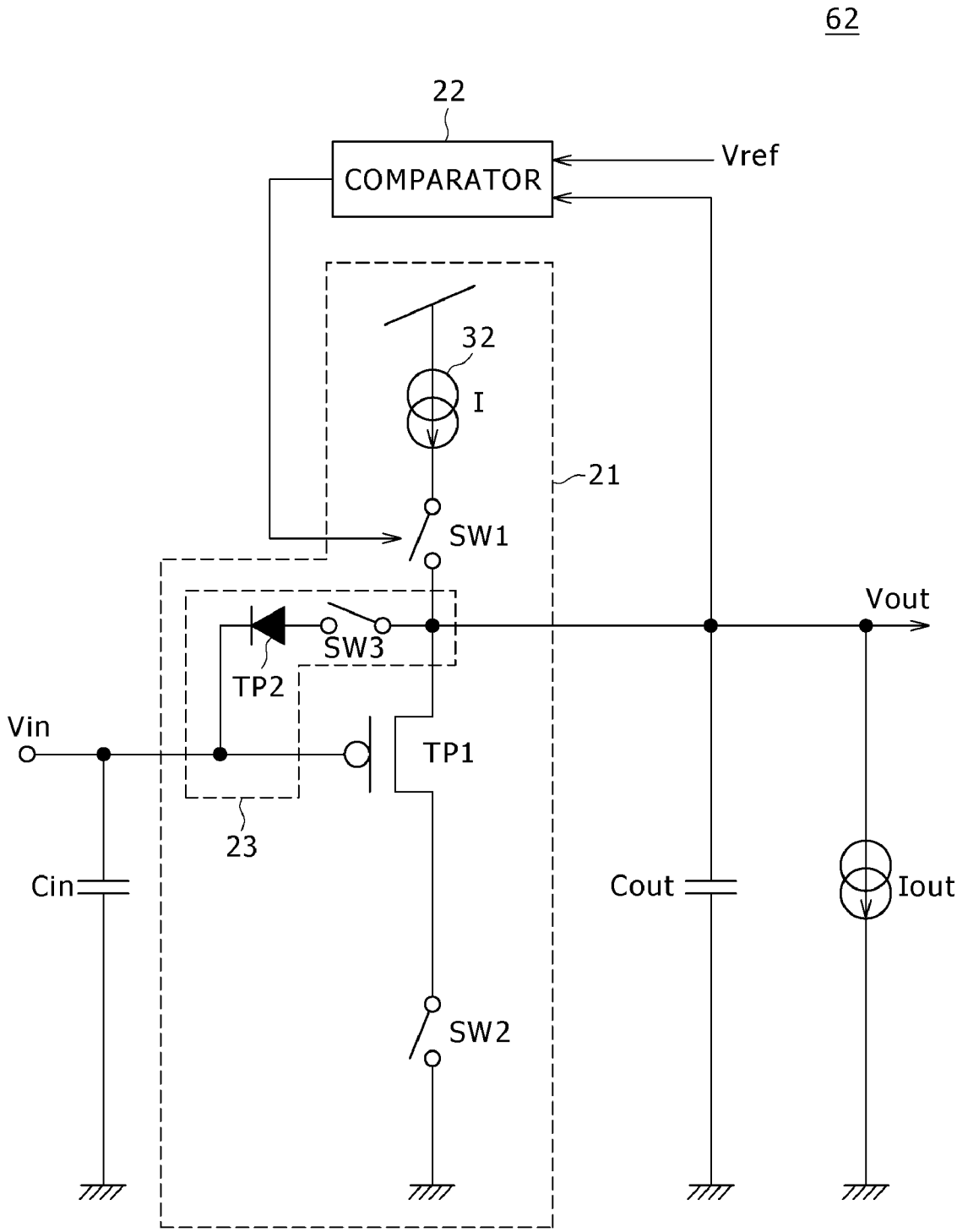
FIG. 6 is a circuit diagram showing an example of a concrete precharge circuit of the voltage generating circuit in the liquid crystal display device according to the second embodiment of the present invention.

FIG. 6 shows an example of a configuration of the voltage generating circuit 62 in the liquid crystal display device 1 of the second embodiment, especially, a concrete precharge circuit thereof. In the circuit configuration in this embodiment, the output circuit 21 is configured in the form of a source follower circuit in which the output circuit 21 is composed of a drive transistor TP1 composed of, for example, a p-channel MOS transistor, and a constant current source 32 similarly to the case shown in FIG. 4. An output terminal is derived from a connection midpoint between a source of the drive transistor TP1 and the constant current source 32. A first switch SW1 is connected between the constant current source 32 and the connection midpoint, and a second switch SW2 is connected between a drain of the drive transistor TP1 and the ground (earth). The input capacitor Cin is connected to an input terminal of the source follower circuit, that is, a gate of the drive transistor TP1, and the output capacitor Cout is connected to an output terminal of the source follower circuit. An input voltage Vin is supplied to the input terminal of the source follower circuit. Also, the first switch SW1 is controlled to be turned ON or OFF in accordance with the output voltage signal from the comparator 22.

In this embodiment, in addition thereto, a diode-connected transistor TP2 is connected between the source of the drive transistor TP1, that is, between the connection midpoint described above and the gate of the drive transistor TP1 as the input terminal of the source follower circuit through a third switch SW3. In this case, the diode-connected transistor TP2 is connected in the forward direction toward the gate of the drive transistor TP1. In FIG. 6, the diode-connected transistor TP2 is represented by a simplified diode symbol. The diode-connected transistor TP2 constitutes the feedback path 23. The diode-connected transistor TP2 is actually configured by connecting a gate and a drain of a p-channel MOS transistor to each other. In order to obtain the forward direction, a source of the diode-connected transistor TP2 is connected to the output terminal side, that is, the source of the drive transistor TP1, and a gate and a drain thereof are connected to the input terminal, that is, the gate of the drive transistor TP1. A channel length L and a channel width W of the diode-connected transistor TP2 composed of the p-channel transistor are the same as those of the drive transistor TP1 composed of the p-channel transistor.

In FIG. 6, reference symbol I designates a bias current caused to flow from the constant current source 32, and reference symbol Iout designates an output load current caused to flow from a constant current source having a terminal connected to the output side of the output circuit 21. It is assumed that the bias current I is larger than the output load current Iout (Iout<I). Also, reference symbols Cin and Cout designate an input capacitor and an output capacitor of the output circuit 21. Since other configurations and connection relationships are the same as those in the first embodiment shown in FIG. 4, a detailed description thereof is omitted here for the sake of simplicity.

Next, a description will be given with respect to an operation of the voltage generating circuit 62 having the precharge circuit configuration shown in FIG. 6. The third switch SW3 is held in an ON state for the precharge time period. The second switch SW2 is normally in an OFF state for the precharge time period. For the precharge time period, the first switch SW1 is controlled to be turned ON or OFF in accordance with the output voltage signal from the comparator 22. That is to say, for the precharge time period, the first switch SW1 is turned ON or OFF in accordance with the result of comparison of the output voltage Vout from the output circuit 21 with the reference voltage Vref in the comparator 22.

That is to say, when Vout<Vref, the first switch SW1 is turned ON, and when Vout>Vref, the first switch SW1 is turned OFF.

It is assumed that each of the input voltage Vin and the output voltage Vout is lower than the optimal precharge voltage (=Vcs) as an initial state. At this time, the first switch SW1 is turned ON concurrently with start of the precharge operation, a part of the bias current I caused to flow from the constant current source 32 is consumed in the form of the output load current Iout, and a remaining part thereof is caused to flow divergingly into the output capacitor Cout, and the input capacitor Cin through the diode-connected transistor TR2 to charge the output capacitor Cout and the input capacitor Cin.

When viewed from the constant current source 32, the impedance is larger in the path leading to the input capacitor Cin than in the path leading to the output capacitor Cout by a length corresponding to the diode-connected transistor TP2. Therefore, the charging is performed more gently for the input capacitor Cin than for the output capacitor Cout. When the output capacitor Cout is charged with the electricity, so that the output voltage Vout becomes equal in level to the reference voltage Vref in the comparator 22, the first switch SW1 is turned OFF, and no bias current I is supplied from the constant current source 32.

At this time, when (Vout−Vin) is larger than a threshold voltage Vth of the diode-connected transistor TP2, the charges are supplied from the output capacitor Cout to the output capacitor Cin. As a result, the output capacitor Cin is charged with the electricity, and the charges accumulated in the output capacitor Cout are discharged. Thus, since the relationship of Vout<Vref is established again, the first switch SW1 is turned ON. The operation is repeatedly carried out, which results in that finally, the following relationship is obtained, and thus the equilibrium condition is obtained:

$$V\text{out}=V\text{ref}$$

$$V\text{in}=V\text{out}-Vth$$

Figure 7:
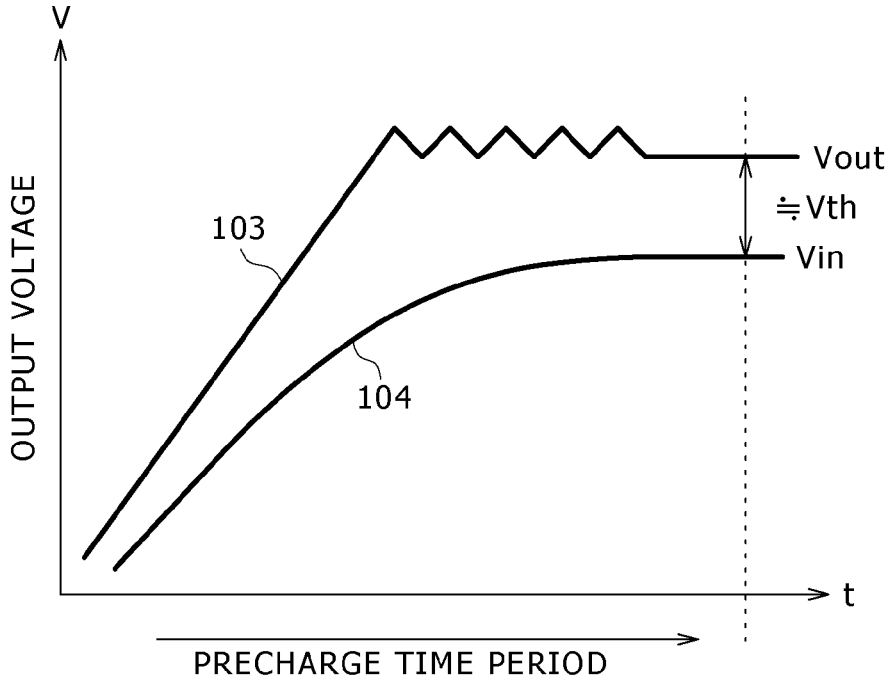
FIG. 7 is a graphical representation conceptually explaining a precharge operation of the precharge circuit shown in FIG. 6.

FIG. 7 is a conceptual diagram schematically showing the precharge operation of the voltage generating circuit 62 shown in FIG. 6. In the figure, reference numeral 103 represents a precharge waveform of the output voltage Vout, and reference numeral 104 represents a precharge waveform of the input voltage Vin. When the precharge time period is sufficiently long, a difference between the output voltage Vout and the input voltage Vin becomes approximately equal in level to the threshold voltage Vth of each of the drive transistor TP1 and the diode-connected transistor TP2 in FIG. 6.

When a p-channel MOS transistor is used as the diode-connected transistor TP2, finally, the input voltage Vin is controlled to become a voltage which is the threshold voltage Vth lower than the output voltage Vout. While the first switch SW1 is held in the ON state, the output capacitor Cout is charged with the electricity. However, when the output voltage Vout reaches the desired output voltage Vcs, the first switch SW1 is turned OFF through the comparator 22. When the first switch SW1 is turned OFF, no charge is supplied to the output capacitor Cout. When the low voltage is still held in the input capacitor Cin, the charges accumulated in the output capacitor Cout are caused to flow into the input capacitor Cin through the diode-connected transistor TP2. Also, when the output voltage Vout is reduced to be lower than the desired optimal precharge output voltage Vcs, the first switch SW1 is turned ON again through the comparator 22 to cause the output voltage Vout to rise. This operation is repeatedly carried out, so that finally, the output voltage Vout is stabilized at the desired output voltage Vcs. The waveform 103 shows this state.

When the normal operation is entered after completion of the precharge operation, the first and second switches SW1 and SW2 are normally turned ON and the output circuit 21 serves as a normal source follower circuit. On the other hand, the third switch SW3 is turned OFF and thus the feedback path 23 becomes an OFF state.

According to the second embodiment, in the voltage generating circuit 6, the output voltage Vout from the output circuit 21 is fed back to the input terminal of the output circuit 21 through the comparator 22. Also, the output voltage Vout from the output circuit 21 is fed back to the gate of the drive transistor TP1 through the feedback path 23, that is, the diode-connected transistor TP2. By adopting this circuit configuration, both the input and output of the output circuit 21 can be more properly precharged, the precharge error can be reduced, and the precision for the precharge operation in the activation phase can be further enhanced.

The precision for the precharge operation can be enhanced and the precharge time period, that is, the time period until completion of the activation can be shortened while the coupling voltage Vcs is optimally controlled without depending on the power source voltage, the manufacture dispersion and the temperature change. In the liquid crystal display device, the normal operation can be entered a little early and the deterioration of the image quality in the early phase of the display can be avoided.

With the circuit configuration shown in FIG. 6, with regard to a voltage relationship obtained in terms of the source follower circuit composed of the p-channel MOS transistor in the phase of the normal operation, the input voltage Vin becomes the gate to source voltage Vgs of the diode-connected transistor TP2 lower than the output voltage Vout. In other words, the voltage relationship of (Vout=Vin+Vgs) is obtained. The operation can smoothly proceed to the normal operation as long as this voltage relationship is precisely held.

In the phase of the precharge operation, when the threshold voltage of the diode-connected transistor TP2 is Vth, the input capacitor Cin is charged with the electricity to obtain the voltage which is the threshold voltage Vth lower than the output voltage Vout. When the threshold voltage Vth is completely equal to the gate to source voltage Vgs of the diode-connected transistor TP2, the relationship described above is established. However, actually, the gate to source voltage Vgs of the drive transistor TP1 when being normally opened is slightly different from the threshold voltage Vth. The threshold voltage Vth is a voltage of a boundary between the case where a current is caused to flow and the case where no current is caused to flow. On the other hand, Vgs is a source to drain voltage required when a current is caused to flow through a drive transistor (TP1). Thus, a voltage higher than Vth is required for Vgs (Vgs>Vth). As a result, the over-charge state is provided in the input capacitor Cin, and thus the relationship between the input voltage and the output voltage does not become strictly precise. The influence of the over-charge on the input side results in that the output voltage Vout becomes higher than the desired voltage Vcs. As a result, it takes time to obtain the desired voltage Vcs.

In other words, in FIG. 6, the diode-connected transistor TP2 is finally charged with the electricity to a point at which a stationary current becomes approximately zero by the precharge. Thus, the gate to source voltage of the drive transistor TP1 is Vgs (ID≈0). On the other hand, although the first and second switches SW1 and SW2 are normally turned ON after completion of the precharge operation, at this time, an amount of current caused to flow from the drive transistor TP1 into the ground (earth) is expressed by (I−Iout). Also, the gate to source voltage required for the drive transistor TP1 at that time is Vgs(ID=I−Iout), and gets a value which is absolutely larger than Vgs(ID≈0) previously stated. That is to say, in the case of the system shown in FIG. 6, there is the possibility that the precharge error occurs from a viewpoint of performing the over-charge for the input voltage Vin with respect to the output voltage Vout.

Although the precision for the precharge operation is higher in the circuit configuration shown in FIG. 6 than in the circuit configuration shown in FIG. 4, a circuit configuration is desired with which the higher precision for the precharge operation is obtained.

Figure 8:
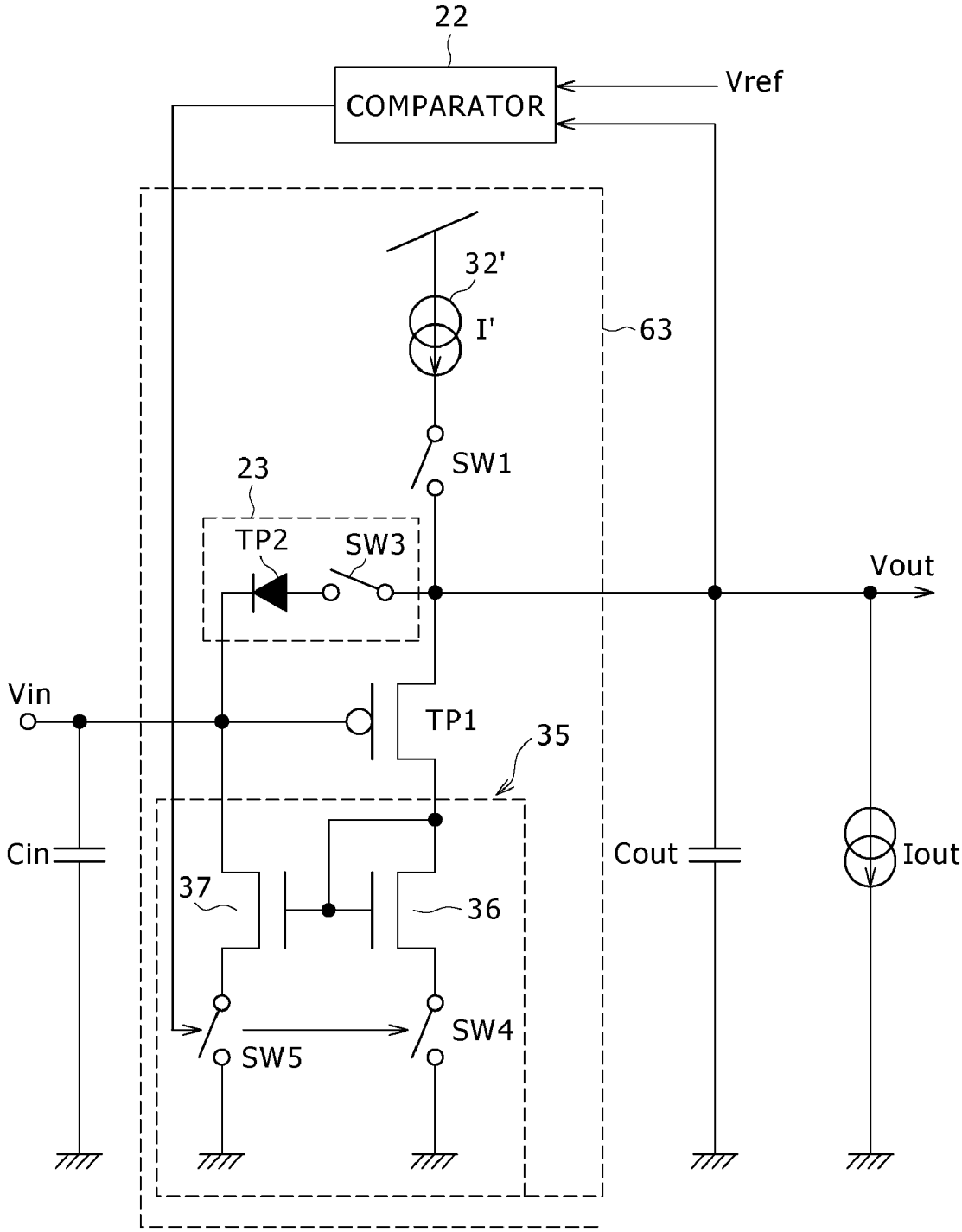
FIG. 8 is a circuit diagram showing another example of a concrete precharge circuit of the voltage generating circuit in the liquid crystal display device according to the second embodiment of the present invention.

FIG. 8 shows another example of the further improved voltage generating circuit in the liquid crystal display device according to the second embodiment of the present invention. That is to say, FIG. 8 shows another example of the concrete precharge circuit configuration in the voltage generating circuit in the liquid crystal display device according to the second embodiment of the present invention shown in FIG. 5. An output circuit 21 of a voltage generating circuit 63 in the second embodiment is composed of a drive transistor TP1 composed of, for example, a p-channel MOS transistor, and a source follower circuit composed of a constant current source 32'. An output terminal is derived from a connection midpoint between a source of a drive transistor TP1 and the constant current source 32', and a first switch SW1 is connected between the constant current source 32' and the connection midpoint. In addition, a diode-connected transistor TP2 is connected to the drain of the drive transistor TP1, that is, between the connection midpoint described above and the gate of the drive transistor TP1 as the input terminal of the source follower circuit through a third switch SW3. In this case, the diode-connected transistor TR2 is connected in the forward direction toward the gate of the drive transistor TP1. The diode-connected transistor TR2 constitutes the feedback path 23. As will be described later, in the phase of the precharge operation, a bias current I' which is larger than the bias current I in the phase of the normal operation is caused to flow from the constant current source 32'.

In the example in this embodiment, moreover, a current mirror circuit 35 is provided. In this case, the current mirror circuit 35 is composed of a transistor for monitoring the current caused to flow through the drive transistor TP1, for example, an n-channel MOS transistor 36, and a transistor consisting a current mirror configuration with the n-channel transistor 36, for example, an n-channel MOS transistor 37. The transistor 36 is connected between a drain of the drive transistor TP1 and the ground (earth) through a fourth switch SW4. Also, the transistor 37 is connected between the gate of the drive transistor TP1 and the ground (earth) through a fifth switch SW5. Both gates of the transistors 36 and 37 are connected to each other and are also connected to the drain of the drive transistor TP1.

The fourth and fifth switches SW4 and SW5 are controlled to be turned ON or OFF in phase with each other in accordance with the output voltage signal from the comparator 22. Since other configurations and connection relationships are the same as those in the case of FIG. 6, corresponding portions are designated by the same reference numerals, respectively, and a repeated description is omitted here for the sake of simplicity.

Next, a description will be given with respect to an operation of the voltage generating circuit 63 having the precharge circuit configuration shown in FIG. 8. The first and third switches SW1 and SW3 are held in an ON state for the precharge time period. Also, for the precharge time period, the fourth and fifth switches SW4 and SW5 are controlled to be turned ON or OFF in accordance with the result of comparison of the output voltage Vout from the output circuit 21 with reference voltage Vref in the comparator 22.

That is to say, when Vout<Vref, the fourth and fifth switches SW4 and SW5 are turned ON, and when Vout>Vref, the fourth and fifth switches SW4 and SW5 are turned OFF.

It is assumed that each of the input voltage Vin and the output voltage Vout is lower than the optimal precharge voltage (=Vcs) as an initial state. At this time, the fourth and fifth switches SW4 and SW5 are turned OFF concurrently with start of the precharge operation, a part of a bias current I' caused to flow from the constant current source 32' is consumed in the form of an output load current Iout, and a remaining part thereof is caused to flow divergingly into the output capacitor Cout, and the input capacitor Cin through the diode-connected transistor TP2 to charge the output capacitor Cout and the input capacitor Cin.

When the output voltage Vout becomes equal in level to the reference voltage Vref in the comparator 22, the fourth and fifth switches SW4 and SW5 are turned ON, so that a current is caused to flow from the drive transistor TP1 to the ground (earth). This current is monitored by one transistor 36, of the current mirror circuit, in one path to be mirrored to the other transistor 37 in the other path. As a result, the same current as that described above is caused to flow from the transistor 37 to the ground (earth).

At this time, an amount, Ipre, of current which is caused to flow through each of these paths, that is, the path from the drive transistor TP1 to the ground (earth), and the path from the diode-connected transistor TP2 to the ground (earth) is steadily given by Expression (3):

$$Ipre=(I'-I\text{out})/2 \tag{3}$$

When the charges accumulated in the output capacitor Cout are discharged, so that a relationship of Vout<Vref is obtained, the fourth and fifth switches SW4 and SW5 are turned OFF again, and thus the output capacitor Cin and the output capacitor Cout are charged with the electricity. The above operation is repeatedly carried out, thereby finally obtaining an equilibrium state. The equilibrium state is expressed by Expression (4):

$$V\text{out}=V\text{ref}$$

$$V\text{in}=V\text{out}-Vgs(ID=(I'-I\text{out})/2) \tag{4}$$

where ID is a drain current of the drive transistor TP1.

Figure 9:
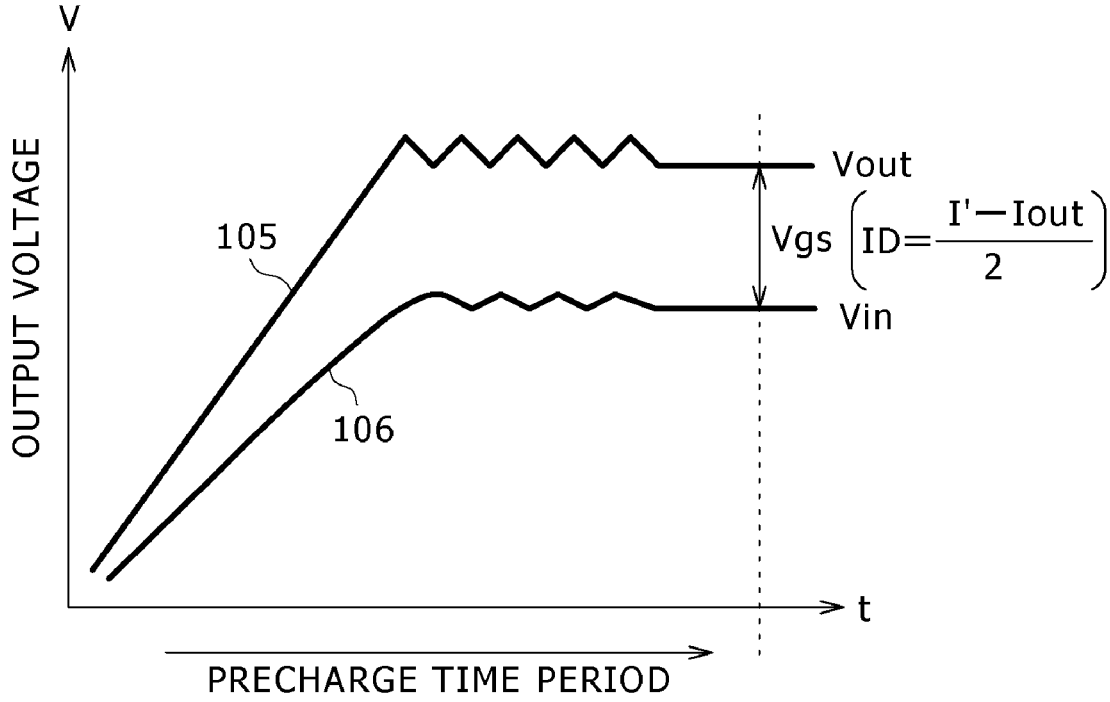
FIG. 9 is a graphical representation conceptually explaining a precharge operation of the precharge circuit shown in FIG. 8.

FIG. 9 is a conceptual diagram schematically showing the precharge operation of the voltage generating circuit shown in FIG. 8. In the figure, reference numeral 105 represents a precharge waveform of the output voltage Vout, and reference numeral 106 represents a precharge waveform of the input voltage Vin. When the precharge time period is sufficiently long, a difference between the output voltage Vout and the input voltage Vin is given by Vgs(ID 32 (I'−Iout)/2) from Expression (4).

When a p-channel MOS transistor is used as the diode-connected transistor TP2, finally, the input voltage Vin is controlled to become a voltage which is the threshold voltage Vgs(ID=(I'−Iout)/2) lower than the output voltage Vout. Here, ID represents the drain current of the drive transistor TP1. Since each of the transistors TP1 and TP2 is composed of the same transistor in this case, each of them has the same gate to source voltage Vgs. The reason that a wave is generated in the waveform 106 of the input voltage Vin in FIG. 9 is because the charge or the discharge is carried out for the input capacitor Cin in accordance with turn-ON or turn-OFF of the fifth switch SW5.

In the operation of the voltage generating circuit 62 shown in FIG. 6 which is previously described, the difference between the output voltage Vout and the input voltage Vin is equal to the threshold voltage Vth of the diode-connected transistor TP2. Compared with this, the feature of the another example of FIG. 8 in this embodiment is that the precharge voltage of the input voltage Vin changes depending on a current (I'−Iout) caused to flow through the output stage. Normally, the gate to source voltage Vgs contains therein the parameters as well of the threshold voltage Vth, and thus the precharge error due to the manufacture dispersion can be canceled.

When an amount of current supplied from the current source after completion of the precharge operation is I, an amount of current caused to flow through the drive transistor TP1 is given by (I−Iout). Thus, when the current source during the precharge operation is set with a current I' fulfilling Expression (5), the precharge error theoretically becomes zero:

$$(I'-I\text{out})/2=I-I\text{out} \tag{5}$$

With regard to the premise for the output circuit 21, the bias current I' in the phase of the precharge operation is larger than the output load current Iout, the bias current I in the phase of the normal operation is larger than the output load current Iout, and the bias current I' is larger than the bias current I (I'>I>Iout). Although not illustrated in FIG. 8, as will be described later with reference to FIG. 13, switching can be made in terms of the constant current source for the source follower circuit to the constant current for causing the bias current I to flow in the phase of the normal operation.

According to the another example of FIG. 8 in the second embodiment, the output voltage Vout is fed back to the output circuit 21 through the comparator 22, and is also directly fed back to the gate of the drive transistor TP1 as the input side through the diode-connected transistor TP2. In addition thereto, the current mirror circuit 35 is provided. By the operation of the current mirror circuit 35, the precharge voltage, on the input side, of the output circuit 21 can be controlled to become the voltage which is the gate to source voltage Vgs of the drive transistor TP1 in the phase of the normal operation lower than the output voltage Vout. For this reason, the precharge error can be made zero as soon as practicable, and the precision for the precharge operation can be further enhanced.

In addition, similarly to the example described above in this embodiment, the precision for the precharge operation can be enhanced and the precharge time period, that is, the time period until completion of the activation can be shortened while the coupling voltage Vcs is optimally controlled without depending on the power source voltage, the manufacture dispersion and the temperature change. In the liquid crystal display device, the normal operation can be entered a little early and the deterioration of the image quality in the early phase of the display can be avoided.

Figure 11:
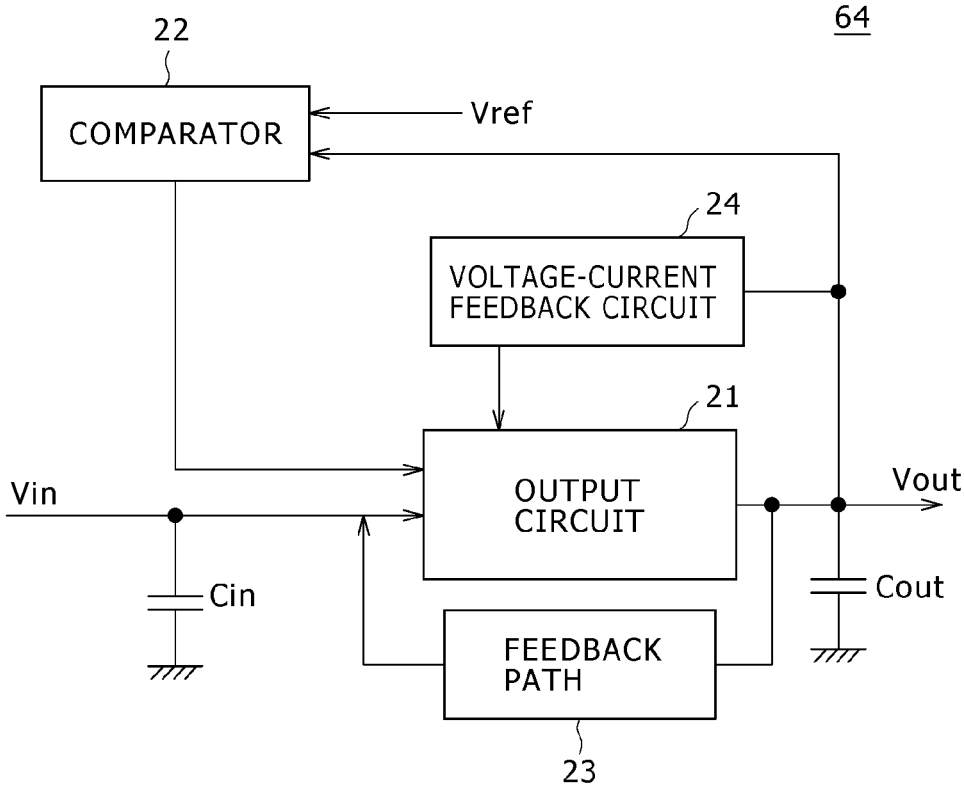
FIG. 11 is a block diagram, partly in circuit, showing a voltage generating circuit in a liquid crystal display device according to a third embodiment of the present invention.

FIG. 11 is a block diagram, partly in circuit, showing a configuration of a voltage generating circuit in a liquid crystal display device according to a third embodiment of the present invention.

As previously stated, when the output circuit 21 is configured in the form of the general source follower circuit, the relationship given by Expression (2) is established. In this case, there is the necessity for quantitatively determining ID (the drain current caused to flow through the drive transistor TP1) in Expression (2). In general, there is a method of supplying a bias current from a current source transistor. The current source transistor means a constant current source transistor which is configured so as to cause a bias current to flow therefrom in accordance with a suitable bias current applied to a gate of a MOS transistor, for example, a p-channel transistor.

Figure 10A:
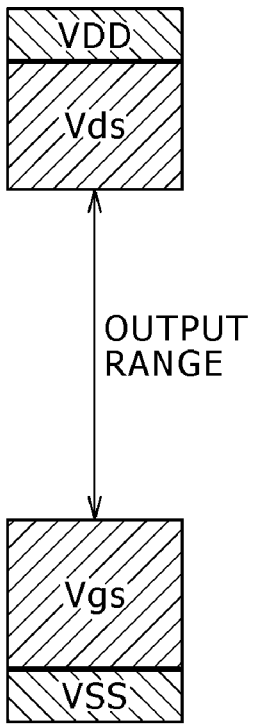
FIGS. 10A and 10B are respectively diagrams explaining comparison of output ranges of source follower circuits.

However, when longitudinally stacked current source transistors are used in the source follower (the source follower composed of the p-channel MOS transistor in this case) circuit, a voltage headroom as shown in FIG. 10A is consumed. This value generally requires several hundreds or more of mV. That is to say, an operation range (a so-called output range) of the precharge does not reach the vicinity of the power source voltage VDD. This leads to the possibility that the precharge error occurs for the output circuit having the low power consumption and the wide dynamic range. It is noted that in FIGS. 10A and 10B, reference symbol Vds is a source to drain voltage in a non-saturated region of the current source transistor, and reference symbol Vgs is a gate to source voltage which is only large enough to turn ON the drive transistor.

Although in recent years, it has been required to reduce the power source voltage, the high voltage is still necessary for the pixel voltage. For the purpose of coping with such a situation, in order to supply the necessary pixel voltage in spite of the reduction in signal amplitude, it is necessary to increase the coupling voltage Vcs. For this reason, for the coupling voltage Vcs outputted from the voltage generating circuit in the phase of the normal operation, it is desired to obtain the coupling voltage Vcs to the voltage close to the power source voltage, that is, to obtain the wide dynamic range. Naturally, supplying the high voltage Vcs from the voltage generating circuit in the phase of the normal operation results in that it is necessary to obtain the high voltage in terms of the precharge voltage as well.

Figure 10B:
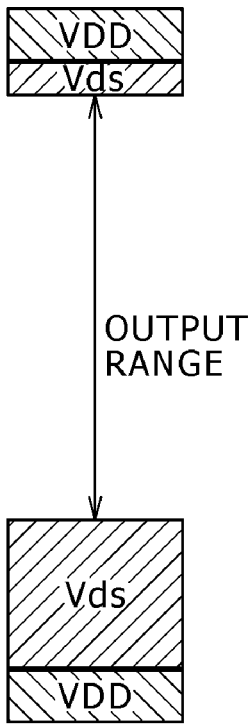

The third embodiment shown in FIG. 11 provides one method of improving the problem described above. A voltage generating circuit 64 in a liquid crystal display device of this embodiment includes an output circuit 21, a comparator 22, and a feedback path 23. In this case, the feedback path 23 is provided between an input terminal and an output terminal of the output circuit 21, and serves to directly feed the output voltage Vout back to the input side of the output circuit 21. Moreover, the voltage generating circuit 64 is provided with a voltage-current feedback circuit 24 for monitoring the output voltage Vout, and controlling a bias current for the output circuit 21 in accordance with the monitoring result. Since other circuit configurations and connection relationships are the same as those in the second embodiment shown in FIG. 5, a detailed description thereof is omitted here for the sake of simplicity. By the operation of the voltage-current feedback circuit 24, even when the output voltage Vout is close to the power source voltage VDD, the suitable bias current is supplied to the output circuit 21, and thus the operating range of the precharge is widened as shown in FIG. 10B.

Figure 12:
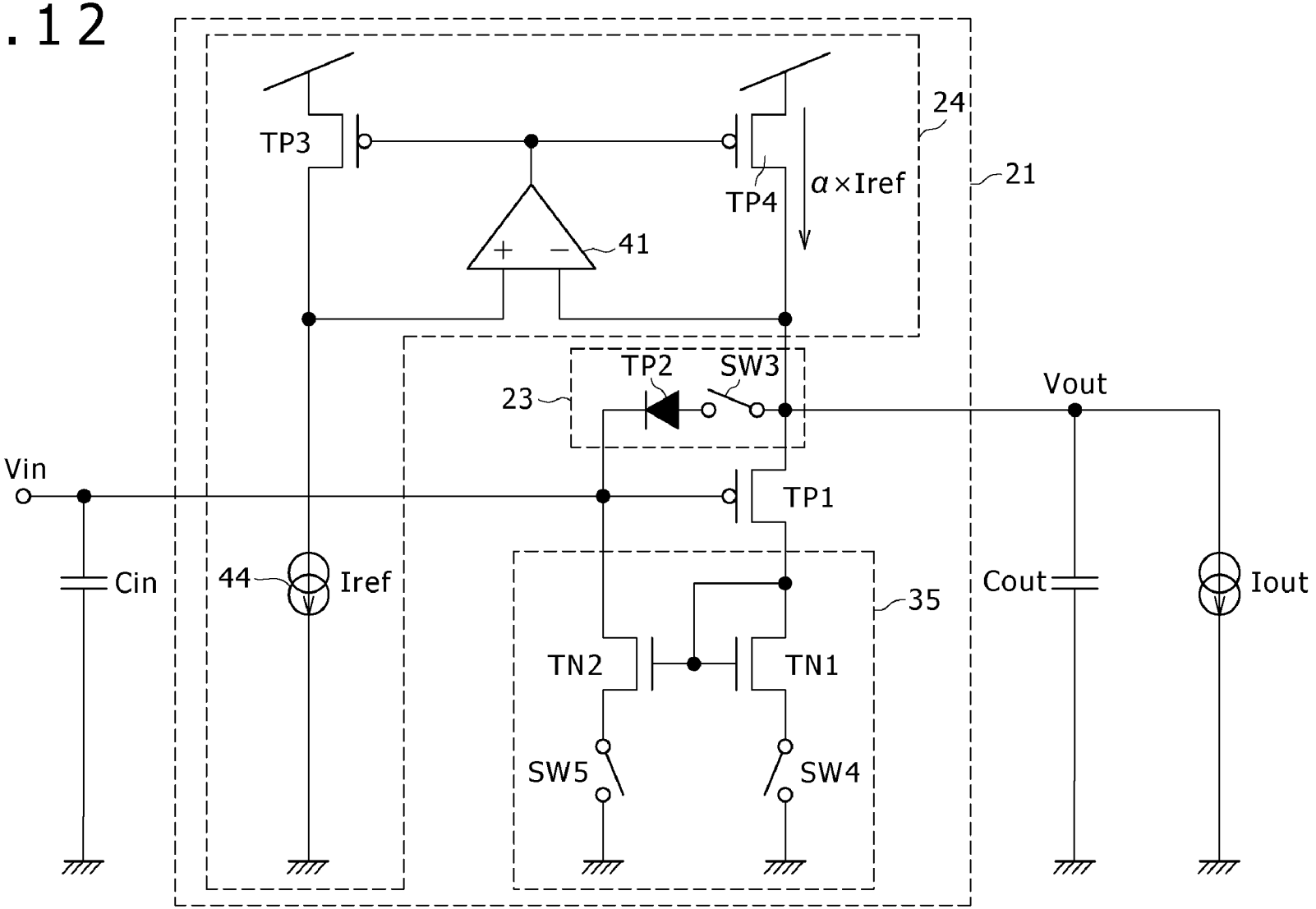
FIG. 12 is a circuit diagram showing an example of a concrete precharge circuit of the voltage generating circuit in the liquid crystal display device according to the third embodiment of the present invention.

FIG. 12 shows an example of a configuration of the voltage generating circuit 64 in the liquid crystal display device 1 of the third embodiment, especially, a concrete precharge circuit thereof.

For the purpose of causing the bias currents I and I' to flow from the constant current sources in the first and second embodiments described above, respectively, it is generally expected to use a constant current transistor in which a suitable bias voltage is applied to a gate of, for example, a p-channel MOS transistor. However, when it is required for the constant current transistor to operate with the output voltage Vout being close to the power source voltage in this case, the operating range can not be ensured in the general current source transistor. As a result, it becomes impossible to supply the current having the intended value. In other words, it is impossible to reach the precise precharge voltage.

The example in the third embodiment shown in FIG. 12 solves the problem described above. An output circuit 21, in this embodiment, having a circuit configuration shown in FIG. 12 includes a drive transistor TP1 composed of, for example, a p-channel MOS transistor constituting a source follower circuit, and a voltage-current feedback circuit 24 having a terminal connected to a source side of the drive transistor TP1. Moreover, the output circuit 21 includes a feedback path 23 having a diode-connected transistor TP2 connected between a source and a gate of the drive transistor TP1, and a current mirror circuit 35 connected between a drain and a gate of the drive transistor TP1.

The voltage-current feedback circuit 24 is composed of an amplifier 41, two transistors TP3 and TP4, and a reference current source 44. In this example, p-channel MOS transistors are used as the transistors TP3 and TP4, respectively. A drain of the transistor TP4 is connected to a source of the drive transistor TP1, and a source thereof is connected to a power source. Also, an output voltage Vout is outputted from a connection midpoint between the drive transistor TP1 and the transistor TP4. The transistor TP4 serves as a constant current source for the source follower circuit. In addition, a source of the transistor TP3 is connected to a power source and the reference current source 44 is connected to a drain of the transistor TP3. On the other hand, an output side of the amplifier 41 is connected to each of gates of the transistors TP3 and TP4, a source of the drive transistor TP1 is connected to an inverting input terminal of the amplifier 41, and a drain of the transistor TP3 for monitoring a reference current Iref is connected to a non-inverting input terminal of the amplifier 41. A mirror ratio (current ratio) of a current caused to flow through the transistor TP3 to a current caused to flow through the transistor TP4 is set at TP3:TP4=1:$\alpha$.

In addition, the current mirror circuit 35 is configured similarly to the case shown in FIG. 8. That is to say, the current mirror circuit 35 includes a transistor TN1 having a terminal connected to the drain of the drive transistor TP1, and a transistor TN2 having a terminal connected to the gate of the drive transistor TP1, and constituting the current mirror configuration with the transistor TN1. Both gates of the transistors TN1 and TN2 are connected to each other and are also connected to the drain of the drive transistor TN1. Moreover, one terminals of fourth and fifth switches SW4 and SW5 are connected to sources of the transistors TN1 and TN2, respectively. The fourth and fifth switches SW4 and SW5 are turned ON or OFF in accordance with an output voltage signal (not shown) from the comparator 22.

Since other circuit configurations and connection relationships are the same as those in the case of FIG. 8, a detailed description thereof is omitted here for the sake of simplicity.

Next, a description will be given with respect to an operation of the voltage generating circuit 63 having the precharge circuit configuration shown in FIG. 12. In the example in this embodiment, the control is performed such that even when the output voltage Vout rises close to the power source voltage, the gate voltage of the transistor TP4 used as the bias current source for the source follower circuit is reduced by the output signal from the amplifier 41, thereby widening the output dynamic range.

That is to say, the precharge circuit is configured such that the amplifier 41 outputs such an output signal as to equalize the output voltage Vout inputted to the inverting input terminal and the drain voltage of the transistor TP3 outputted to the non-inverting input terminal to each other. Now, when the output voltage Vout rises close to the power source voltage, it is inputted to the inverting input terminal of the amplifier 41, and also the drain voltage, of the transistor TP3, having the same voltage value as that of the output voltage Vout is inputted to the non-inverting input terminal. At this time, the amplifier 41 outputs the low voltage signal so that even when the drain voltage increases, the reference current Iref is caused to flow from the reference current source 44 to the transistor TP3. That is to say, the reference current Iref is caused to flow through the transistor TP3 under the condition that the gate to source voltage Vgs of the transistor TP3 is increased, which results in that the amplifier 41 applies the low voltage to the gate of the transistor TP3. The output voltage signal is also applied from the amplifier 41 to the gate of the transistor TP4 serving as the current source transistor for the source follower circuit, which results in that a current ($\alpha\times$Iref) is caused to flow through the transistor TP4, so that the output circuit 21 becomes operable.

As apparent from the characteristics of the transistor TP4, that is, the I–Vds characteristics of the transistor TP4, when the gate to source voltage Vgs of the transistor TP4 is increased (that is, the gate voltage thereof is reduced), the large current I ($=\alpha+$Iref) is obtained even if the output voltage Vout becomes near the power source voltage to reduce the drain to source voltage Vds.

As has been described above, in this example in the third embodiment, even in the region in which the transistor TP4 does not operate as the constant current source because the output voltage Vout rises close to the power source voltage to cause the transistor TP4 to enter the non-saturated region, the amplifier 41 controls the gate voltage of the transistor TP4, thereby making it possible to usually supply the current ($=\alpha\times$ Iref).

On the other hand, in the output circuit 21, the diode-connected transistor TP2 is connected between the source and gate of the drive transistor TP1, and also the current mirror circuit 35 is provided. As a result, the precharge circuit of this example in the third embodiment operates similarly to the case shown in FIG. 8, and thus the precharge error can be made zero as soon as practicable.

Figure 13:
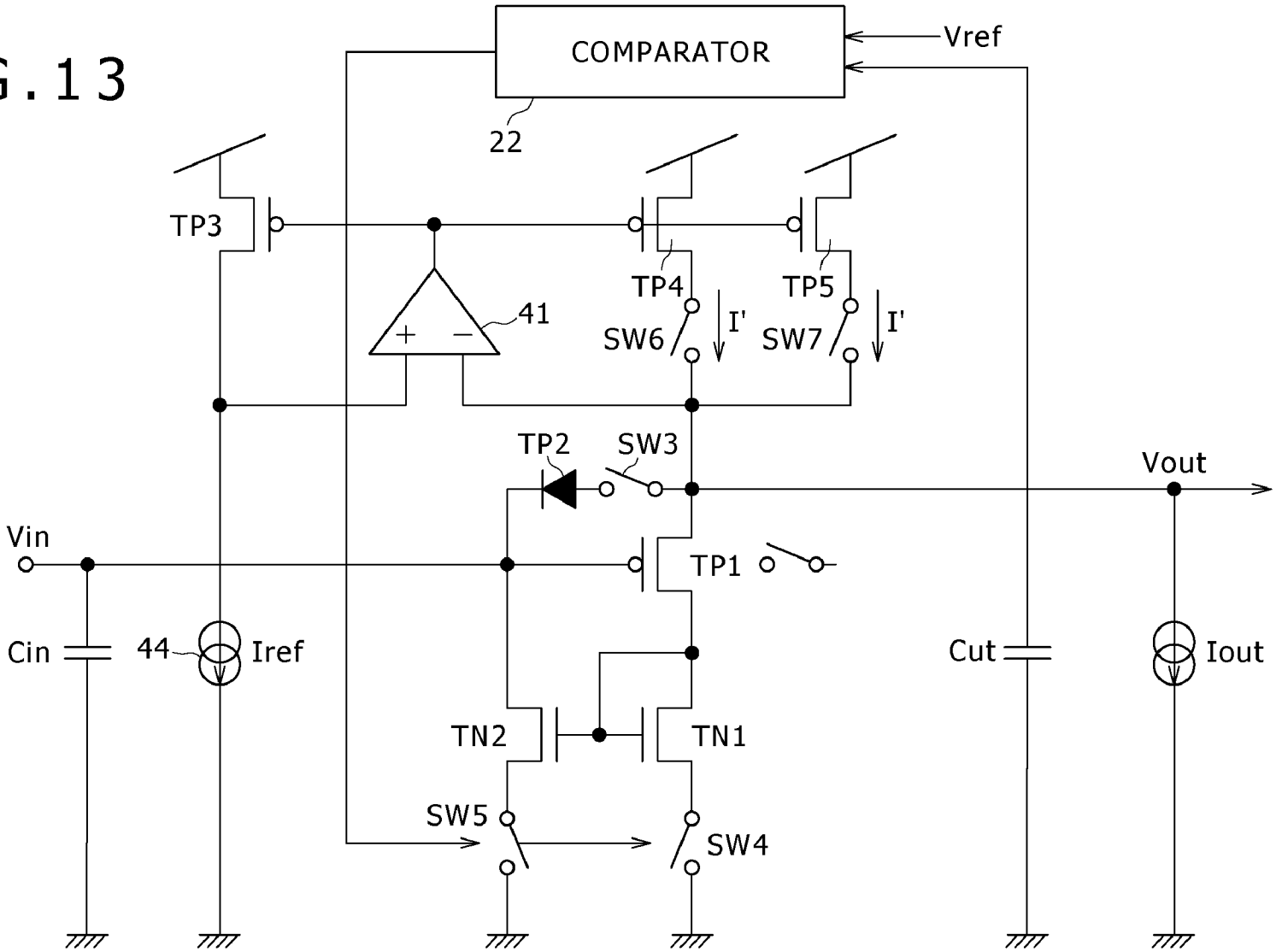
FIG. 13 is a concrete circuit diagram showing the entire voltage generating circuit of the liquid crystal display device according to the third embodiment of the present invention.

FIG. 13 shows another example of a configuration of the voltage generating circuit in the liquid crystal display device 1 of the third embodiment, that is, a concrete precharge circuit of the entire voltage generating circuit in the liquid crystal display device 1 of the third embodiment. In the circuit configuration of the another example in the third embodiment, in addition to the provision of the circuit configuration shown in FIG. 12, the comparator 22 to which the output voltage Vout and the reference voltage Vref are inputted is provided. In this case, the fourth and fifth switches SW4 and SW5 provided in the respective paths of the current mirror circuit 35 are controlled to be turned ON or OFF in accordance with the output voltage signal from the comparator 22. In addition, a sixth switch SW6 is connected between the transistor TP4 as the current source transistor and the drive transistor TP1. Also, a connection circuit of a transistor TP5 and a seventh switch SW7 is provided in parallel with the connection circuit of the transistor TP4 and the sixth switch SW6.

The transistors TP4 and TP5 are provided for the purpose of separating the bias current I' for the precharge time period, and the bias current I for the normal operation time period. The sixth switch SW6 is held in the ON state only driving the precharge operation, and the seventh switch SW7 is held on the ON state during the normal operation after completion of the precharge operation.

Since other circuit configurations and connection relationships in FIG. 13 are the same as those in the case of FIG. 12, a repeated description is omitted here for the sake of simplicity.

According to this example in the third embodiment, the input capacitor and the output capacitor can be controlled to have the optimal values for the output circuit 21, respectively, without depending on the conditions such as the manufacture dispersion, the output load current value, the power source voltage, and the temperature change. In addition, the provision of the voltage-current feedback circuit 24 results in that the dynamic ranges of the input voltage Vin and the output voltage Vout in the output circuit 21 can be widened, thereby making it possible to obtain the output voltage Vout, that is, the coupling voltage Vcs up to the voltage close to the power source voltage. As a result, it is possible to realize the low power consumption in the liquid crystal display device.

In other words, there is adopted the precharge controlling method of monitoring the current being caused to flow through the output stage, thereby making it possible to ensure the optimal gate to source voltage Vgs of the current source transistor. As a result, the influence of the power source voltage, the manufacture dispersion, the output load current and the like is canceled, thereby precisely realizing the precharge operation having the wide dynamic range.

In addition, there are obtained the same effects as those described in the example in the second embodiment with reference to FIG. 8. That is to say, the output voltage Vout is fed back to the output circuit 21 through the comparator 22, and is also fed back to the gate of the drive transistor TP1 through the diode-connected transistor TP2. In addition thereto, the current mirror circuit 35 is provided. By the operation of the current mirror circuit 35, the precharge voltage, on the input side, of the output circuit 21 can be controlled to become the voltage which is the gate to source voltage Vgs of the drive transistor TP1 in the phase of the normal operation lower than the output voltage Vout. For this reason, the precharge error can be made zero as soon as practicable, and the precision for the precharge operation can be further enhanced.

The precision for the precharge operation can be enhanced and the precharge time period, that is, the time period until completion of the activation can be shortened while the coupling voltage Vcs is optimally controlled. As a result, in the liquid crystal display device, the normal operation can be entered a little early and the deterioration of the image quality in the early phase of the display can be avoided.

Figure 14:
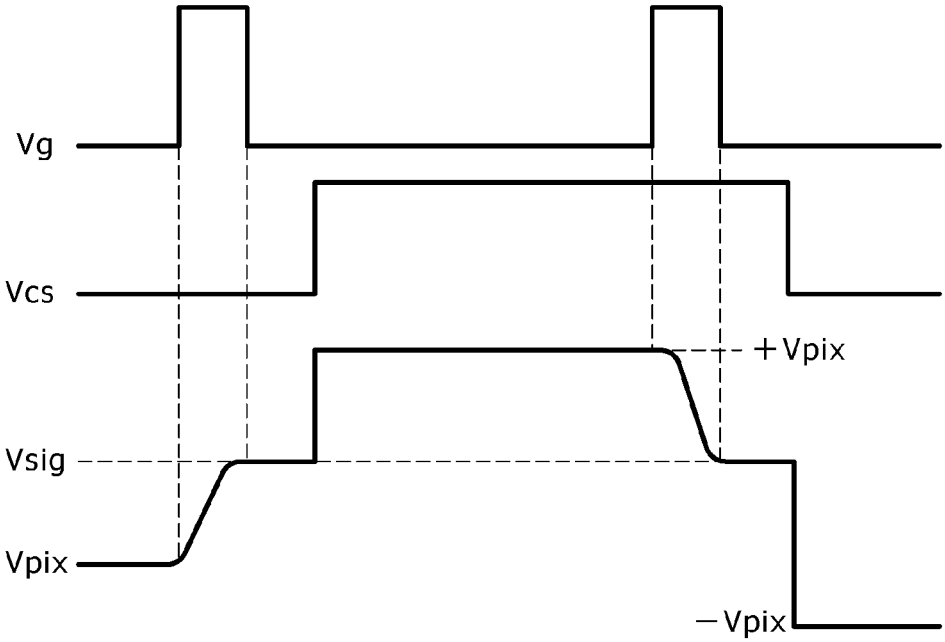
FIG. 14 is a timing chart explaining the present invention.

FIG. 14 shows a timing chart of the gate voltage Vg of the thin film transistor 11 as the switching element in the pixel portion, the coupling voltage Vcs supplied from the voltage generating circuit 6 to the coupling capacitors Cs, the video signal Vsig, and the pixel voltage Vpix. A gate pulse ϕv is applied to the gate of the thin film transistor 11 to turn ON the thin film transistor 11, thereby writing the video signal Vpix to the pixel cell 12 through the corresponding one of the signal lines 9. After the thin film transistor 11 is turned OFF, the coupling voltage Vcs is supplied from the voltage generating circuit 6 to the coupling capacitor Cs, and the pixel voltage Vpix of the pixel cell is held at the voltage of (Vsig+Vcs). In the next frame, the polarity of the pixel voltage Vpix is inverted.

According to the third embodiment shown in FIGS. 11 to 13, the input capacitor and the output capacitor can be precharge-controlled to have the optimal capacitance values for the output circuit, respectively, without depending on the conditions such as the manufacture dispersion and the load current value, and the dynamic range of the precharge voltage can be widened. In addition thereto, there are offered the same effects as those in the example in the second embodiment described with reference to FIG. 8.

According to the third embodiment described above, the optimal precharge voltage is supplied to the input side while the output signal is controlled to have the certain value, which results in that the precharge error of the output value can be lightened, and the return time from the precharge error can be shortened. The shortening of the blanking time period accelerates the starting-up of the liquid crystal display device in the various applications such as the phases of the power activation, the return from the sleep state, and the application activation in the mobile display of, for example, the mobile phone, thereby bringing out the added value of the liquid crystal display device.

In addition, according to the third embodiment, the constant voltage for the precharge operation becomes unnecessary as compared with the case where a certain fixed constant voltage is applied for the precharge voltage in the related art. In addition, the general-purpose properties are widened without limiting the application because the control can be performed to have the optimal precharge voltage without depending on the dispersion in the manufacturing processes, the power source voltage, and the load current value.

When the gate voltage of the current source transistor is controlled by using the amplifier, the operating range for the precharge is widened. Thus, this circuit configuration can be realized in the form of the precharge function for the output circuit having the low power source voltage for the low power consumption.

Figure 15:
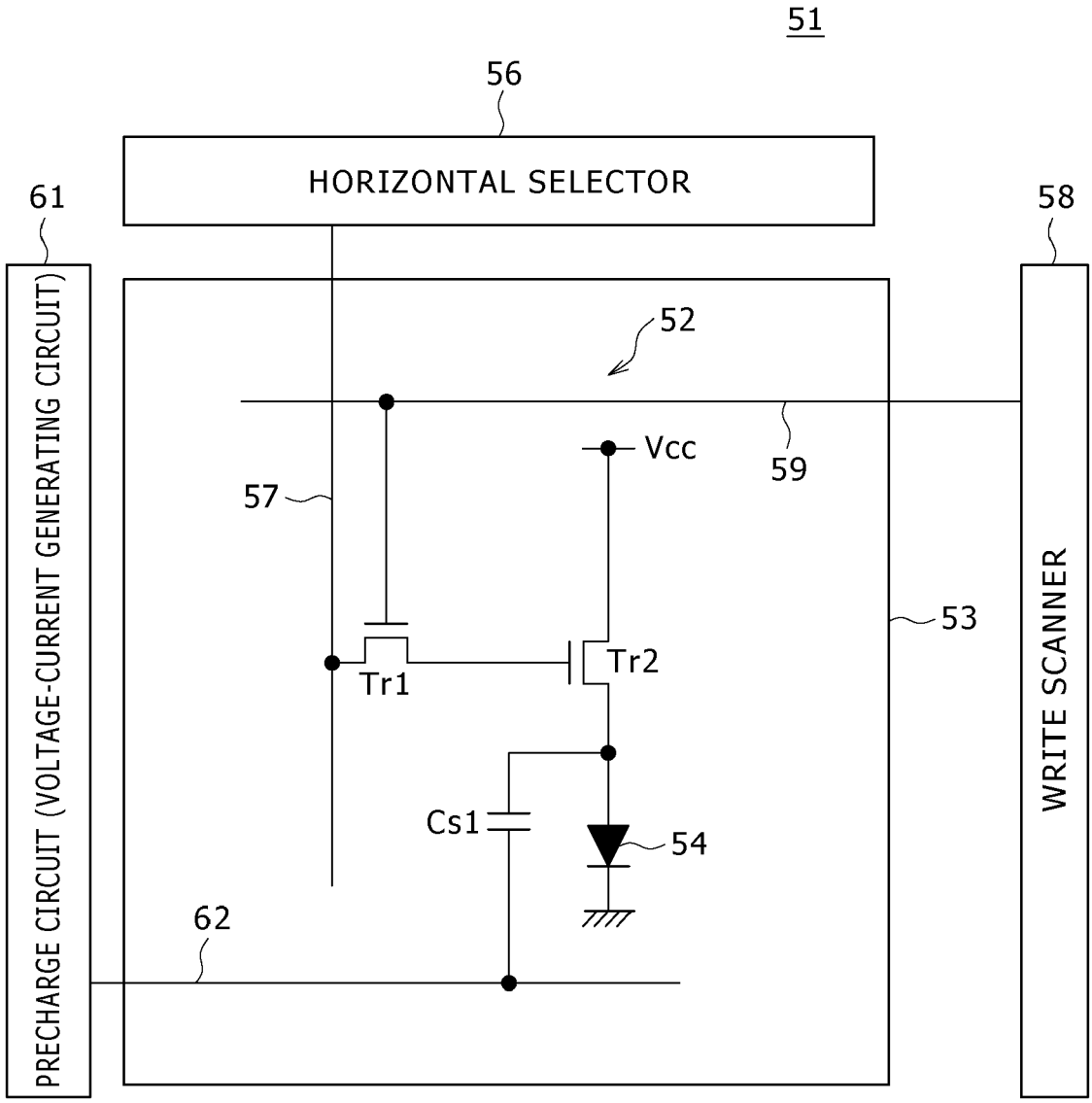
FIG. 15 is a schematic block diagram, partly in circuit, of an organic EL display device according to an embodiment of the present invention.
Figure 16:
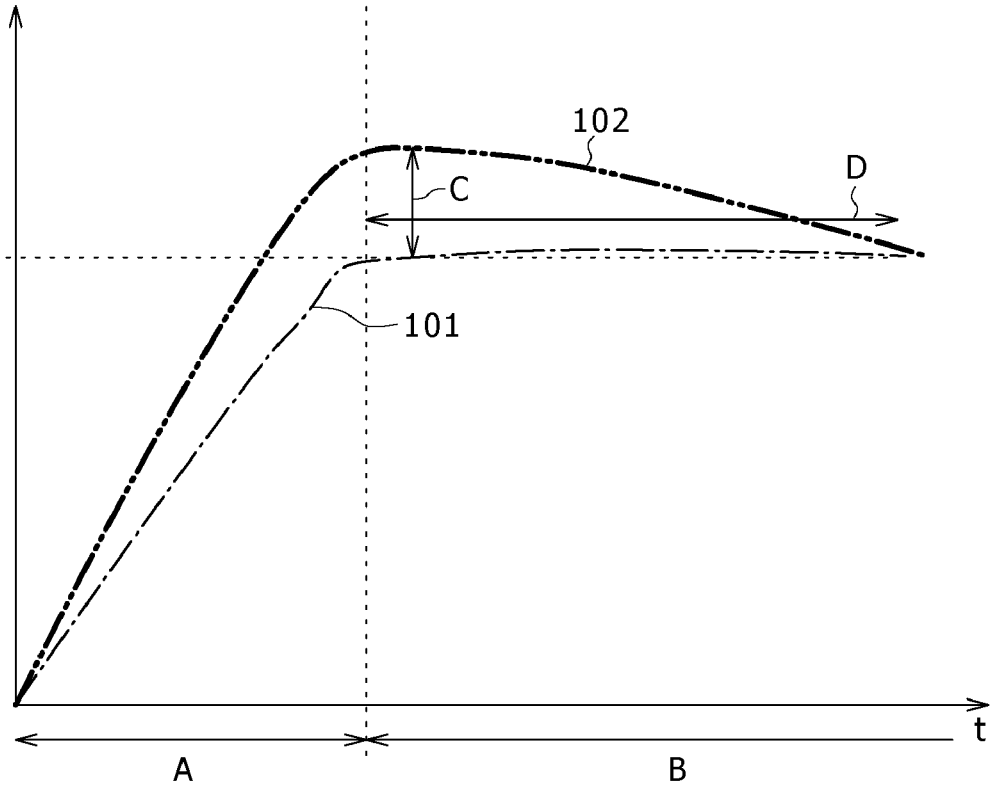
FIG. 16 is a graphical representation conceptually explaining a difference in a precharge operation between the case where a precharge voltage is controlled, and the case where no precharge voltage is controlled.

The above is the case where the precharge controlling method of the present invention is applied to the liquid crystal display device. In addition thereto, the present invention is also applied to an organic electro-luminescence (EL) display device using the capacitive coupling drive system. FIG. 15 shows a schematic configuration of the organic EL display device using the capacitive coupling drive system according to an embodiment of the present invention, and an equivalent circuit of a unit pixel. An organic EL display device 51 according to this embodiment of the present invention has a display region 53 in which a plurality of organic EL pixels 52 are disposed in a matrix. The unit pixel 52 in this embodiment is composed of an organic EL cell 54, a current drive transistor Tr2, a switching transistor Tr1, and a coupling capacitor Cs1.

A drain of the switching transistor Tr1 is connected to corresponding one, of signal lines 57, which is selected by a horizontal selector 56 and to which a signal corresponding to luminance information is supplied. A source of the switching transistor Tr1 is connected to a gate of the current drive transistor TR2, and a gate thereof is connected to corresponding one of scanning lines 59 wired from a write scanner 58. A drain of the current drive transistor Tr2 is connected to a power source VCC, and a source thereof is connected to an anode of the organic EL cell 54. Moreover, one terminal of the coupling capacitor Cs1 is connected to corresponding one of precharge wirings 62 wired from a precharge circuit (that is, a voltage-current generating circuit) 61.

In the organic EL pixel 52, the switching transistor Tr1 is turned ON by supplying a scanning signal from a cathode ray tube to the corresponding one of the scanning lines 59 by the write scanner 58. Also, the signal corresponding to the luminance information is supplied to the gate of the current drive transistor Tr2 through the corresponding one of the signal lines 57, thereby turning ON the current drive transistor Tr2. At this time, a current is supplied from the power source VCC to the organic μL cell 54. On the other hand, a given current previously passes through the corresponding one of the precharge wirings 62 to be supplied from the precharge circuit 61 to the organic EL cell 54 through the coupling capacitor Cs1. The organic EL cell 54 is driven for display by a current obtained by adding the current supplied through the corresponding one of the precharge wirings 62 to the current supplied from the power source VCC.

The above precharge controlling method of the present invention can also be applied to the organic EL display device of this embodiment.

In addition, the above precharge controlling method of the present invention can also be applied to other electronic devices.

It should be understood by those skilled in the art that various modifications, combinations, sub-combinations and alterations may occur depending on design requirements and other factors insofar as they are within the scope of the appended claims or the equivalents thereof.

What is claimed is:

1. A precharge controlling method, comprising the steps of:

providing a voltage generating circuit with (a) an output circuit for outputting a voltage having a necessary level, and (b) a comparator;

comparing an output voltage from said output circuit with another voltage using said comparator during a precharge time period, and feeding back an output signal from said comparator to said output circuit; and controlling a precharge voltage until the voltage having the necessary level output from said output circuit is reached, wherein, said output circuit is configured in a form of a source follower circuit composed of a drive transistor and a constant current source, and a switching element connected between an output terminal of said output circuit and said constant current source is controlled in accordance with the output signal from said comparator.

2. The precharge controlling method according to claim 1, wherein the output voltage from said output circuit is fed back to an input side of said output circuit through a feedback path comprising a diode-connected transistor.

3. A precharge controlling method, comprising the steps of:

providing a voltage generating circuit with (a) an output circuit for outputting a voltage having a necessary level, and (b) a comparator;

comparing an output voltage from said output circuit with another voltage using said comparator during a precharge time period, and feeding back an output signal from said comparator to said output circuit; and controlling a precharge voltage until the voltage having the necessary level output from said output circuit is reached, wherein, the output voltage from said output circuit is fed back to an input side of said output circuit through a feedback path, said output circuit is configured in a form of a source follower circuit composed of a drive transistor and a constant current source, a diode-connected transistor constitutes said feedback path, a current mirror circuit is provided, so that a current flowing through said diode-connected transistor is controlled so as to be equalized to a current flowing through said drive transistor, and the current mirror circuit includes switching elements, provided in respective current paths, that are controlled in accordance with the output signal from said comparator.

4. The precharge controlling method according to claim 3, wherein a bias current in said output circuit is controlled through a voltage-current feedback circuit, the voltage-current feedback circuit composed of a first transistor that serves as the constant current source for said source follower circuit, a second transistor through which a reference current flows, and an amplifier, and a bias current in said first transistor is controlled by controlling a gate of said first transistor in accordance with an output from said amplifier.

5. The precharge controlling method according to claim 4, wherein a third transistor is further connected in parallel with said first transistor, the third transistor serves as the constant current source during a phase of a normal operation, and the first transistor serves as the constant current source during a phase of a precharge operation, and said first transistor and said third transistor are switched over respectively for the phase of the precharge operation and the phase of the normal operation.

6. A display device, comprising:

pixel portions disposed so as to correspond to intersection portions in which scanning lines and signal lines intersect with each other, respectively, each of said pixel portions comprising a switching element, a pixel cell, and a coupling capacitor; and a voltage generating circuit for supplying a coupling voltage to each of said coupling capacitors, wherein, said voltage generating circuit includes (a) an output circuit for outputting the coupling voltage, and (b) a comparator, during a precharge time period, said comparator compares an output voltage from said output circuit with another voltage, and an output signal from said comparator is fed back to said output circuit, a precharge voltage is controlled until the coupling voltage output from said output circuit is reached, said output circuit is configured in a form of a source follower circuit composed of a drive transistor and a constant current source, and a switching element connected between an output terminal of said output circuit and said constant current source is controlled in accordance with the output signal from said comparator.

7. The display device according to claim 6, wherein the output voltage from said output circuit is fed back to an input side of said output circuit through a feedback path having a diode-connected transistor connected between an output terminal and an input terminal of said output circuit.

8. A display device, comprising:

pixel portions disposed so as to correspond to intersection portions in which scanning lines and signal lines intersect with each other, respectively, each of said pixel portions comprising a switching element, a pixel cell, and a coupling capacitor; and a voltage generating circuit for supplying a coupling voltage to each of said coupling capacitors, wherein, said voltage generating circuit includes (a) an output circuit for outputting the coupling voltage, and (b) a comparator, during a precharge time period, said comparator compares an output voltage from said output circuit with another voltage, and an output signal from said comparator is fed back to said output circuit, a precharge voltage is controlled until the coupling voltage output from said output circuit is reached, the output voltage from said output circuit is fed back to an input side of said output circuit through a feedback path, said output circuit is configured in a form of a source follower circuit composed of a drive transistor and a constant current source, the feedback path having a diode-connected transistor is connected between an output terminal and an input terminal of said output circuit, a current mirror circuit is provided for equalizing a current flowing through said diode-connected transistor to a current flowing through said drive transistor, and the current mirror circuit includes switching elements, provided in respective current paths, that are controlled in accordance with the output signal from said comparator.

9. The display device according to claim 8, further comprising a voltage-current feedback circuit for controlling a bias current in said output circuit, the voltage-current feedback circuit composed of a first transistor that serves as the constant current source for said source follower circuit, a second transistor through which a reference current flows, and an amplifier, said voltage-current feedback circuit serving to control a bias current in said first transistor by controlling a gate of said first transistor in accordance with an output from said amplifier.

10. The display device according to claim 9, wherein a third transistor is further connected in parallel with said first transistor, the third transistor serves as the constant current source during a phase of a normal operation, and the first transistor serves as the constant current source during a phase of a precharge operation, and said first transistor and said third transistor are switched over respectively for the phase of the precharge operation and the phase of the normal operation.

* * * * *